US008302769B2

(12) United States Patent
Justiss

(10) Patent No.: US 8,302,769 B2
(45) Date of Patent: Nov. 6, 2012

(54) MULTI-FUNCTION CASE FOR PORTABLE DIGITAL MEDIA DEVICE

(75) Inventor: Nathaniel B. Justiss, Charleston, SC (US)

(73) Assignee: Philips Electronics North America Corporation, Andover, MA (US)

( * ) Notice: Subject to any disclaimer, the term of this patent is extended or adjusted under 35 U.S.C. 154(b) by 472 days.

(21) Appl. No.: 11/872,591

(22) Filed: Oct. 15, 2007

(65) Prior Publication Data

US 2009/0084705 A1 Apr. 2, 2009

Related U.S. Application Data

(63) Continuation-in-part of application No. 29/295,490, filed on Sep. 28, 2007, now Pat. No. Des. 570,593.

(51) Int. Cl.
*A45C 15/00* (2006.01)
*B65D 85/00* (2006.01)

(52) U.S. Cl. ..... 206/38; 206/320; 220/480; 224/197; 224/666; 224/908

(58) Field of Classification Search ..... 206/38, 206/305, 320, 578, 589, 724, 725; 24/3.7, 24/3.12, 470, 472; 224/197, 666, 908; 220/476, 220/480, 481, 483; 455/344, 348, 351
See application file for complete search history.

(56) References Cited

U.S. PATENT DOCUMENTS

| | | | | |
|---|---|---|---|---|
| 2,217,455 | A | | 10/1940 | Price et al. |
| 2,908,382 | A | | 10/1959 | Turner |
| 3,136,408 | A | | 6/1964 | Rockmann |
| 3,179,891 | A | * | 4/1965 | Sharma ..... 206/38 |
| 4,736,861 | A | * | 4/1988 | Basili ..... 220/632 |
| 4,828,153 | A | * | 5/1989 | Guzik et al. ..... 224/242 |
| D317,157 | S | | 5/1991 | Jondelius |
| D337,435 | S | | 7/1993 | Kaneko et al. |
| 5,339,461 | A | | 8/1994 | Luplow |
| 5,383,091 | A | | 1/1995 | Snell |
| D365,927 | S | | 1/1996 | Cho |
| 5,494,157 | A | | 2/1996 | Golenz et al. |
| D385,283 | S | | 10/1997 | Snyder et al. |
| 5,684,883 | A | | 11/1997 | Chen |
| 5,710,728 | A | | 1/1998 | Danielson et al. |
| 5,832,098 | A | | 11/1998 | Chen |
| 5,833,100 | A | * | 11/1998 | Kim ..... 224/197 |
| 5,867,355 | A | | 2/1999 | Arai et al. |
| 5,897,040 | A | | 4/1999 | Ward |
| 5,923,752 | A | | 7/1999 | McBride et al. |
| D444,454 | S | | 7/2001 | Hanna et al. |
| D462,677 | S | | 9/2002 | Eroma |
| 6,633,770 | B1 | | 10/2003 | Gitzinger et al. |
| D484,874 | S | | 1/2004 | Chang et al. |
| 6,765,145 | B2 | | 7/2004 | Cheynet et al. |

(Continued)

FOREIGN PATENT DOCUMENTS

JP 09-018984 A 1/1997

(Continued)

*Primary Examiner* — Luan K Bui

(57) ABSTRACT

A protective case or mounting device for a portable digital media device includes a first and a second snap fit cavity adapted to receive and selectively retain a first and a second protrusion element, respectively, associated with any of various accessory mounting or position retention elements. Connection between respective protrusions and snap fit cavities is made by depressible insertion. A portable digital media device may thus be removably engaged to various positioning elements without requiring the device to be removed from a protective case.

17 Claims, 17 Drawing Sheets

U.S. PATENT DOCUMENTS

| | | | | |
|---|---|---|---|---|
| 6,999,805 | B2 | 2/2006 | Gartrell et al. | |
| 7,248,904 | B2 | 7/2007 | Gartrell et al. | |
| 7,257,422 | B2 | 8/2007 | Loprete | |
| D560,350 | S | 1/2008 | Scapillato et al. | |
| 7,431,161 | B2 * | 10/2008 | Carlino | 206/581 |
| 2001/0002003 | A1 | 5/2001 | Kuzdak et al. | |
| 2001/0035242 | A1 | 11/2001 | Hughs et al. | |
| 2004/0256188 | A1 | 12/2004 | Harcourt | |
| 2005/0247584 | A1 * | 11/2005 | Lu | 206/320 |
| 2006/0085801 | A1 | 4/2006 | Cheah et al. | |
| 2007/0154048 | A1 * | 7/2007 | Chang | 381/371 |
| 2007/0165371 | A1 | 7/2007 | Brandenburg | |

FOREIGN PATENT DOCUMENTS

| | | | |
|---|---|---|---|
| JP | 3121090 | U | 4/2006 |
| WO | 2005099344 | A2 | 10/2005 |

* cited by examiner

FIG._3A
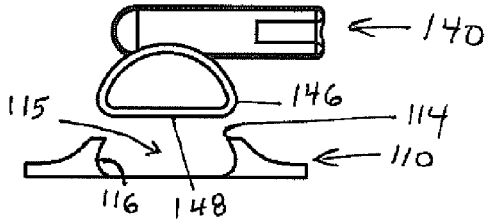
FIG._3B
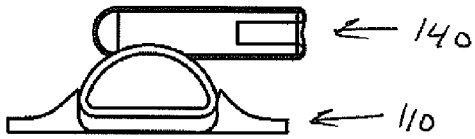
FIG._3C
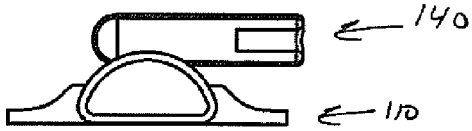
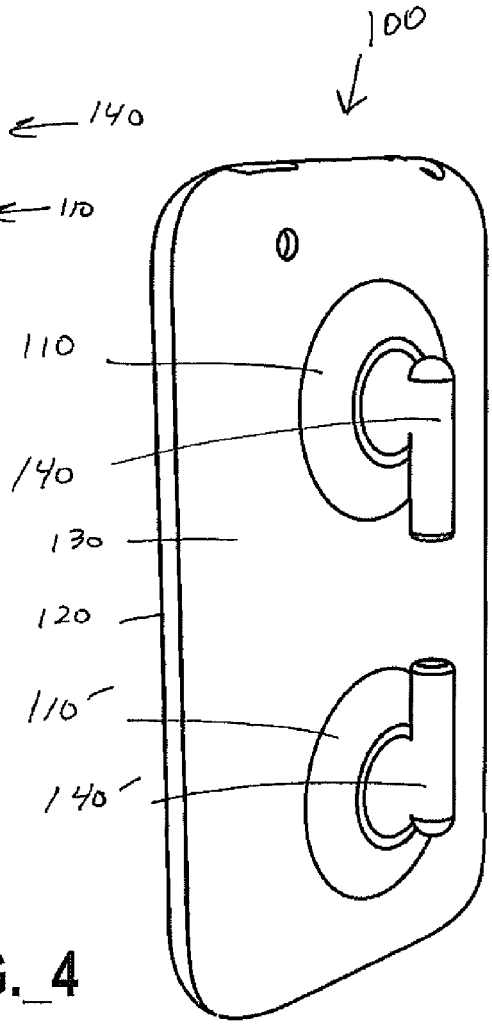
FIG._4

MULTI-FUNCTION CASE FOR PORTABLE DIGITAL MEDIA DEVICE

STATEMENT OF RELATED APPLICATION(S)

This application claims benefit of U.S. patent application Ser. No. 29/295,490 filed on Sep. 28, 2007, issued May 21, 2008 as U.S. Design Pat. No. D570,593.

FIELD OF THE INVENTION

The present invention relates to protective cases and mounting devices for portable digital media devices, such as digital audio/video/photo storage and playback devices and portable telephones.

DESCRIPTION OF THE RELATED ART

Media players of various types are ubiquitous throughout the world, and have evolved over recent decades through various forms, from tape cassette players, to compact disc players, and more recently to portable digital media storage and playback devices that enable a user to obtain digital media files (e.g., by download from an Internet site) and store same in storage medium of a player in any of various preferably compressed formats for subsequent selective playback. Preferred digital media storage and playback devices utilize hard drives and/or flash memory to store digital media files. A number of digital media storage and playback devices have been developed and are commercially available, including: the iPod® family of products made commercially available by Apple Computer, Inc., the Zune® family of products made commercially available by Microsoft, Inc., and the Zen® family of products made commercially available from Creative Technology Ltd. More recently, portable telephone, personal digital assistant, and digital media (e.g., audio, video, and/or image) storage and playback functionalities have converged in versatile devices such as the Treo® family of products made commercially available by Palm, Inc. and the iPhone™ family of products made commercially available by Apple Computer.

As more and more features are integrated into modern portable digital media devices, the cost of such devices has increased substantially. Given the high cost and relative fragility of such devices, users often desire to keep such devices in protective cases to provide protection against damage.

Users of portable digital media devices often desire to keep such devices available for use at times, in a variety of different environments. While at work, a user may desire to keep a portable digital media device fastened to a belt via a belt clip. When traveling by vehicle, a user may desire to keep a portable digital media device mounted by adhesion to an automobile dashboard or affixed by suction cups to a hard surface. While exercising, a user may desire to retain a portable digital media device within an armband or waistband. Dedicated cases or mounting devices to independently provide the foregoing utilities are commonplace.

It is cumbersome for users to frequently swap portable digital media devices in and out of different cases or mounting devices providing specialized utility. It would be desirable to provide a case or mounting device that would confer a desired level of protection against inadvertent damage to a portable digital media device, and yet be selectively adapted to a variety of different uses and environments without requiring removal of a portable digital media device contained therein. It would be particularly desirable for a versatile case to be selectively joinable to various accessory mounts or positioning elements with minimal user manipulation (e.g., avoiding threaded or similarly fussy connectors), yet for such joined connection to be secure in use.

SUMMARY OF THE INVENTION

The present invention relates, in various embodiments, to a protective case and/or mounting device for a portable digital media device, with such case and/or mounting device including a first and a second snap fit cavity adapted to receive and selectively retain a first and a second protrusion element, respectively, associated with any of various accessory mounting or position retention elements. Such a case containing a portable digital media device may thus be easily and selectively affixed to various accessories without requiring removal of the portable digital media device.

In one aspect, the invention relates to a mounting device adapted to maintain a portable digital media device in a desired position or mounting arrangement, the mounting device comprising: an engagement element adapted to engage said portable digital media device; a first snap fit cavity associated with said engagement element, said first snap fit cavity being dimensioned to receive and selectively retain a first protrusion element depressibly insertable into said first snap fit cavity; and a second snap fit cavity associated with said engagement element, said second snap fit cavity being adapted to receive and selectively retain a second protrusion element depressibly insertable into said second snap fit cavity.

In another aspect, the invention relates to a mounting device adapted to maintain in a desired position or mounting arrangement a portable digital media device having (a) an engagement element adapted to engage said portable digital media device, (b) a first snap fit cavity associated with said engagement element, and (c) a second snap fit cavity associated with said engagement element, the mounting device comprising: a position retention element; a first protrusion element associated with said position retention element, the first protrusion element being shaped and dimensioned for depressible insertion into and selective retention by the first snap fit cavity; and a second protrusion element associated with said position retention element, the second protrusion element being shaped and dimensioned for depressible insertion into and selective retention by the second snap fit cavity In a further aspect, the invention relates to a case for a portable digital media device, the case comprising: an engagement element adapted to cover at least a portion of the portable digital media device, said engagement element defining an opening or window to permit viewing of a display associated with said portable digital media device; a first snap fit cavity disposed in or on said engagement element and dimensioned to receive and selectively retain a first protrusion element depressibly insertable into said first snap fit cavity, said first snap fit cavity being defined by at least one surface comprising a slip-resistant material; and a second snap fit cavity disposed in or on said engagement element and dimensioned to receive and selectively retain a second protrusion element depressibly insertable into said second snap fit cavity, said second snap fit cavity being defined by at least one surface comprising a slip-resistant material.

A further aspect of the invention relates to a method for positioning or mounting a portable digital media device, the method comprising: engaging said portable digital media device to an engagement element having associated therewith a first snap fit cavity and a second snap fit cavity, said first snap fit cavity being dimensioned to receive and selectively retain a first protrusion element, and said second snap fit cavity being dimensioned to receive and selectively retain a second protrusion element; manipulating a position retention element into a desired position or mounting arrangement, said position retention element having associated therewith said first protrusion element and said second protrusion element; registering (a) the first protrusion element with the first snap fit cavity, and (b) the second protrusion element with the second snap-fit cavity; and depressing any of the engagement element and the position retention element against the other to effectuate insertion of the first protrusion element into the first snap fit cavity, and insertion of the second protrusion element into the second snap fit cavity.

In a further aspect of the invention, any of the foregoing aspects may be combined for additional advantage. Other aspects, features and embodiments of the invention will be more fully apparent from the ensuing disclosure and appended claims.

BRIEF DESCRIPTION OF THE DRAWINGS

FIG. 3A is a side cross-sectional view of the snap fit cavity-defining structure of FIG. 1B having a headphone earbud registered thereto prior to insertion of the earbud into the snap fit cavity.

FIG. 3B is a side cross-sectional view of the structure and earbud of FIG. 3A, with the earbud being in a position partially inserted into the snap fit cavity and elastically deforming the cavity-defining structure.

FIG. 3C is a side cross-sectional view of the structure and earbud of FIGS. 3A-3B, with the earbud being fully inserted into the snap fit cavity, and with the cavity-defining structure having returned to a non-deformed state such as shown in FIG. 3A.

FIG. 4 is a rear perspective view of the case of FIG. 2A with first and second earbud headphones disposed partially within and retained by the first and second snap fit cavities, respectively.

DETAILED DESCRIPTION OF THE INVENTION, AND PREFERRED EMBODIMENTS THEREOF

Figure 1A:
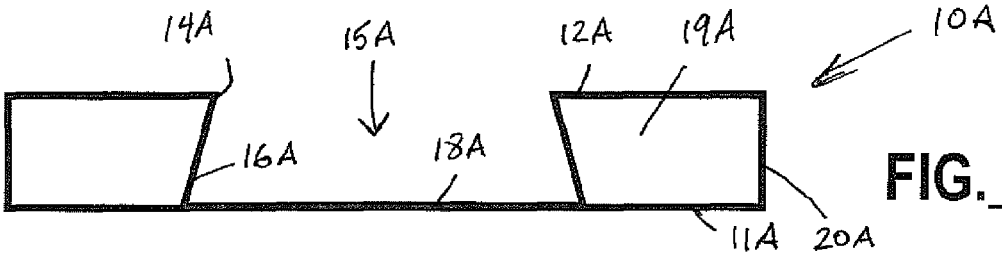
FIG. 1A is a side cross-sectional view of a structure defining a first snap fit cavity adapted to receive and selectively retain a first protrusion element.

The present invention relates, in various embodiments, to a protective case and/or mounting device for a portable digital media device, with such case and/or mounting device including a first and a second snap fit cavity adapted to receive and selectively retain a first and a second protrusion element, respectively, associated with any of various accessory mounting elements. Such a case containing a portable digital media device may thus be easily selectively affixed to various accessories without requiring removal of the portable digital media device.

Each snap-fit cavity is preferably defined by at least one surface comprising a slip-resistant material to prevent undesired movement or slippage of a protrusion element fastened thereto. Desirable slip resistant materials include rubber and silicone rubber. A slip resistant material may or may not be characterized by tack or other surface adhesion properties. A surface may be rendered slip resistant by various conventional techniques including surface modification and surface roughening. Material defining a snap fit cavity is preferably pliable, flexible, and/or elastic in character, at least along a mouth portion thereof, to aid in insertion and removal of a protrusion element. A surface defining the snap fit cavity is preferably threadless, as the cavity is adapted to permit depressible insertion of a protrusion thereinto, without requiring threaded engagement.

A protrusion element adapted for depressible insertion into and selective retention by a snap fit cavity preferably also comprises a slip resistant material, such as described hereinabove, to prevent undesired movement or slippage when engaged by such a snap fit cavity. At least an exterior portion of a protrusion element may also be formed of a pliable, flexible, and/or elastic material to aid in inserting the protrusion element into, and removing the protrusion element from, a snap fit cavity.

It is desirable to provide both first and second snap fit cavities, rather than just a single snap fit cavity, to provide secure connection with an element defining first and second protrusions adapted to mate with such cavities. The presence of multiple cavities adapted to mate with multiple protrusions reduces uncontrolled positional movement such as pivoting or rotation.

In one embodiment, each snap-fit cavity is defined in a molded body formable by various techniques, such as injection molding. A structure defining a snap-fit cavity may be integrally formed with a case for a portable digital media device, or such cavity-defining structure may be joined by any conventional technique to a case adapted to retain a portable digital media device. For example, a structure defining a snap-fit cavity may be adhered to, and/or lockably engaged to, an appropriate case structure.

Cases for portable digital media devices may be provided in various forms and materials. A case is preferably adapted to engage at least a portion of a portable digital media device. In this regard, a case may be considered to be an engagement element for a portable digital media device. Other types of engagement elements (for example, including one or more straps or device retaining structrures, whether or not encasing a portable digital media device, may be used. In one embodiment, a case includes a plurality of portions that may be mated together to encase a portable digital media device; such case may be formed at least in part with a rigid or substantially non-pliable material such as polycarbonate. In another embodiment, at least a portion of a case is formed with a substantially non-rigid, flexible, or pliable material (e.g., molded silicone, rubber, or the like) that may be stretched or otherwise temporarily deformed to permit a portable digital media device to be inserted and/or removed from the case. In another embodiment, a case includes at least one fastener used to engage portions of the case together. Suitable fasteners include screws, clips, snaps, hooks, hook and loop tape, and the like. In one embodiment, at least a portion of the case is formed of fabric or another soft covering material (e.g., animal skin, polymeric material, synthetic rubber materials, and the like). Such a fabric or soft material case may include a sew-in panel or adhered panel having formed therein (or thereon) a first and a second snap-fit cavity.

The term "snap fit cavity" as used herein refers to a cavity or recess having a reduced lateral (e.g., diametric) dimension past which at least a portion of a protrusion element is inserted for selective retention of the protrusion element portion in the cavity. A snap fit cavity should be dimensioned to receive and selectively retain a protrusion element depressibly insertable into the cavity. A snap fit cavity typically has a mouth portion that is slightly smaller in lateral dimension than the remainder of the cavity. A snap fit cavity and associated mouth portion may be formed in various shapes, such as circular, oval, generally triangular, generally rectangular, and so on. In a preferred embodiment, the mouth of a snap fit cavity is substantially circular in shape. Structures defining snap fit cavities of various different types are shown in FIGS. 1A-1E.

FIG. 1A illustrates a first structure 10A comprising a substantially solid material 19A having a lower outer surface 11A, an upper outer surface 12A, and an outer side surface 20A. A mouth 14A defines an upper boundary of a snap fit cavity 15A, which is bounded laterally by a tapered lateral inner surface 16A and lower inner surface 18A. The lateral dimension (e.g., diameter or width) of the cavity 15A increases in a direction from the mouth 14A to the lower inner surface 18A. Such configuration permit a protrusion element (not shown) having an outwardly flaring portion to be inserted past the mouth 14A and selectively but securely retained in the cavity 15A. The material 19A may be elastic or flexible in character to enable slight deformation of the mouth 14A to aid in insertion of a protrusion element (not shown) into the snap fit cavity 15A.

Figure 1B:
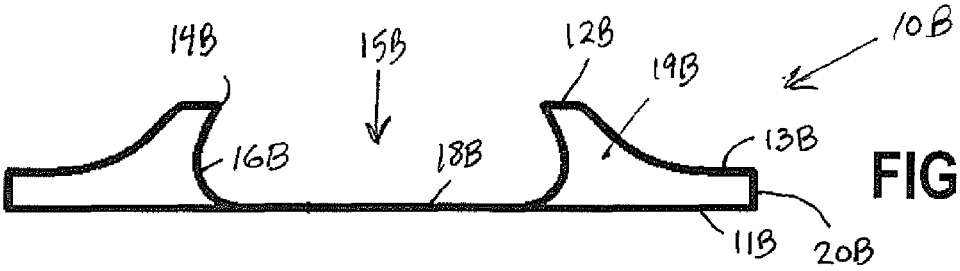
FIG. 1B is a side cross-sectional view of a structure defining a second snap fit cavity adapted to receive and selectively retain a second protrusion element.

FIG. 1B illustrates a second structure 10B comprising a substantially solid material 19B having a lower outer surface 11B, a medial upper outer surface portion 12B that thins to a lateral upper outer surface portion 13B, and an outer side surface 20B. A mouth 14B defines an upper boundary of a snap fit cavity 15B, which is bounded laterally by a curved lateral inner surface 16B and lower inner surface 18B. The lateral dimension (e.g., diameter or width) of the cavity 15B is at a maximum between the mouth 14B and the lower inner surface 18B. The reduction in average thickness of the material 19B due to the tapering of the medial upper outer surface portion 12B to a lateral upper outer surface portion 13B provides enhanced flexibility to the mouth 14B, to assist in inserting or removing a protrusion element relative to the snap fit cavity 15B.

Figure 1C:
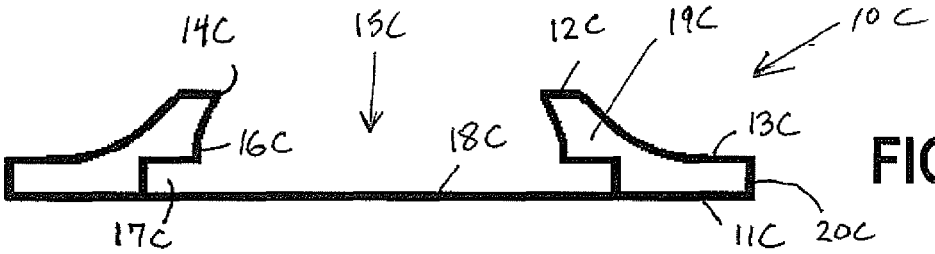
FIG. 1C is a side cross-sectional view of a structure defining a third snap fit cavity adapted to receive and selectively retain a third protrusion element.
Figure 9A:
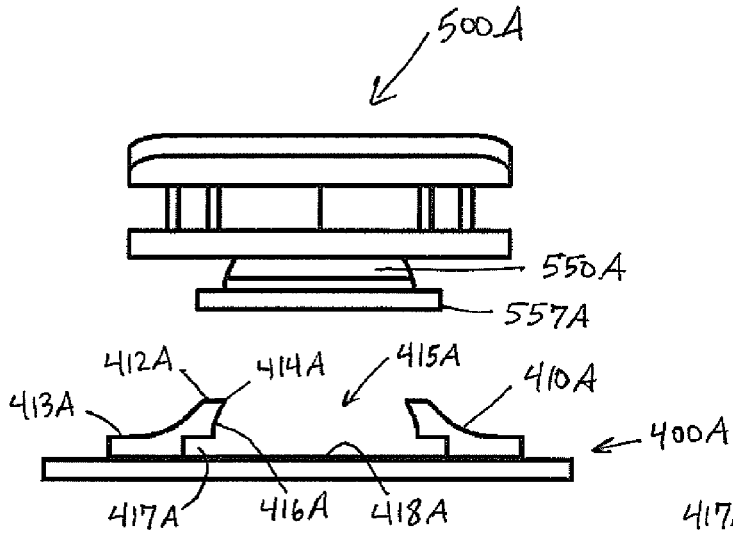
FIG. 9A is a top cross-sectional view of a second belt clip mounting element similar to the belt clip mounting element of FIGS. 8A-8E but having first and second protrusion elements with outwardly flaring peripheral portions, the second belt clip mounting element being registered with a mounting plate having defining first and second snap fit cavities adapted to receive the first and second protrusion elements.
Figure 9B:
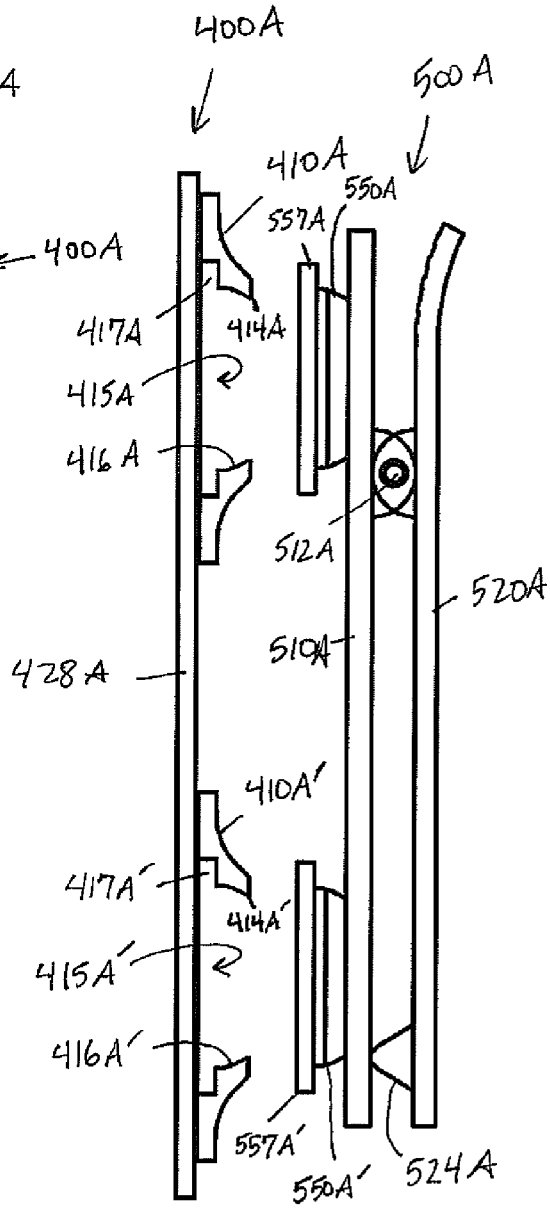
FIG. 9B is a side cross-sectional view of the second belt clip mounting element and mounting plate of FIG. 9A.

FIG. 1C illustrates a third structure 10C comprising a substantially solid material 19C having a lower outer surface 11C, a medial upper outer surface portion 12C that thins to a lateral upper outer surface portion 13C, and an outer side surface 20C. A mouth 14C defines an upper boundary of a snap fit cavity 15C, which is bounded laterally by a curved lateral inner surface portion 16C, a locking radial cavity portion 17C, and a lower inner surface 18C. The lateral dimension (e.g., diameter or width) of the cavity 15C is at a maximum at the locking radial cavity portion 17C, which is disposed between the mouth 14C and the lower inner surface 18C. The locking radial cavity portion 17C is adapted to receive a corresponding outwardly projecting portion of a protrusion element (e.g., as shown in FIGS. 9A-9B) to enhance retention of such a protrusion element.

Figure 1D:
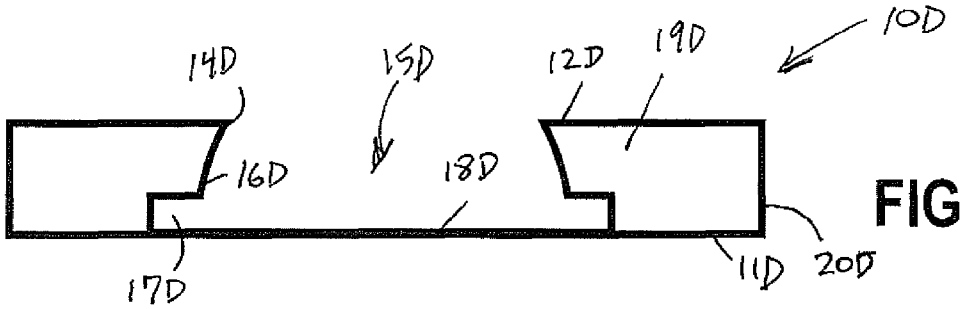
FIG. 1D is a side cross-sectional view of a structure defining a fourth snap fit cavity adapted to receive and selectively retain a fourth protrusion element.

FIG. 1D illustrates a fourth structure 10D that enhances the basic shape of the structures 10A shown in FIG. 1A with the locking radial cavity portion illustrated in the structure 10C of FIG. 1C. The fourth structure 10D comprises a substantially solid material 19D having a lower outer surface 11D, an upper outer surface 12D, and an outer side surface 20D. A mouth 14D defines an upper boundary of a snap fit cavity 15D, which is bounded laterally by a tapered lateral inner surface 16D, a locking radial cavity portion 17D, and lower inner surface 18D. The lateral dimension (e.g., diameter or width) of the cavity 15D generally increases in a direction from the mouth 14D to the lower inner surface 18D, reaching a maximum at the locking radial cavity portion 17D.

Figure 1E:
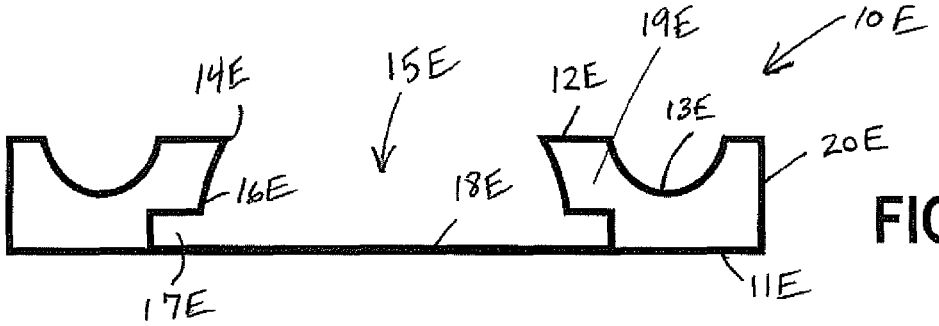
FIG. 1E is a side cross-sectional view of a structure defining a fifth snap fit cavity adapted to receive and selectively retain a protrusion element.
Figure 2A:
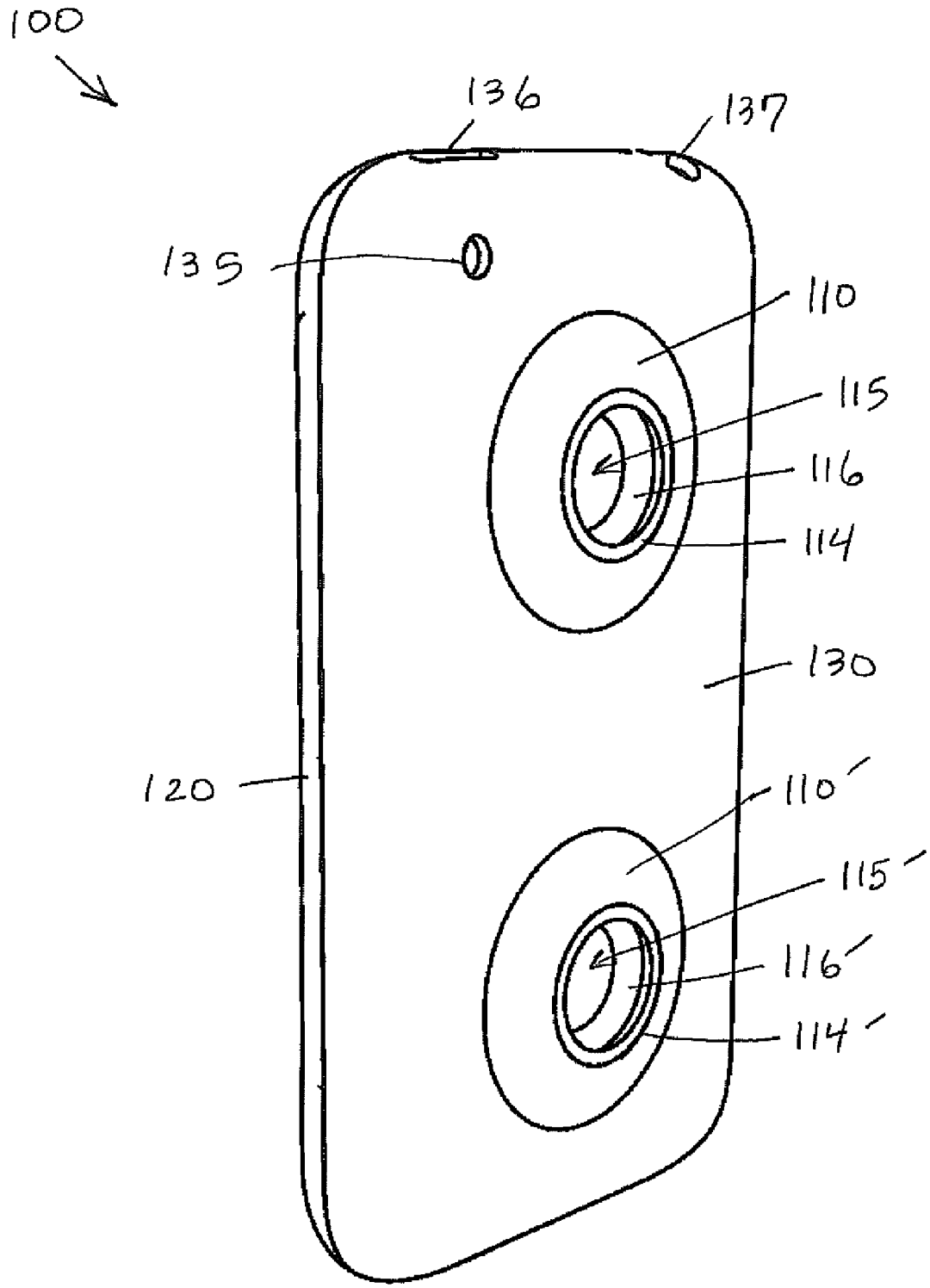
FIG. 2A is a rear perspective view of a first assembled case for a portable digital media device, the case being formed of multiple housing portions and having structure defining first and second snap fit cavities along a rear surface of the case.
Figure 2B:
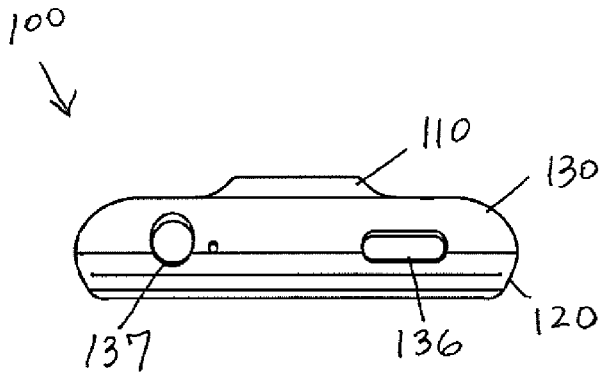
FIG. 2B is a top plan view of the case of FIG. 2A.
Figure 2C:
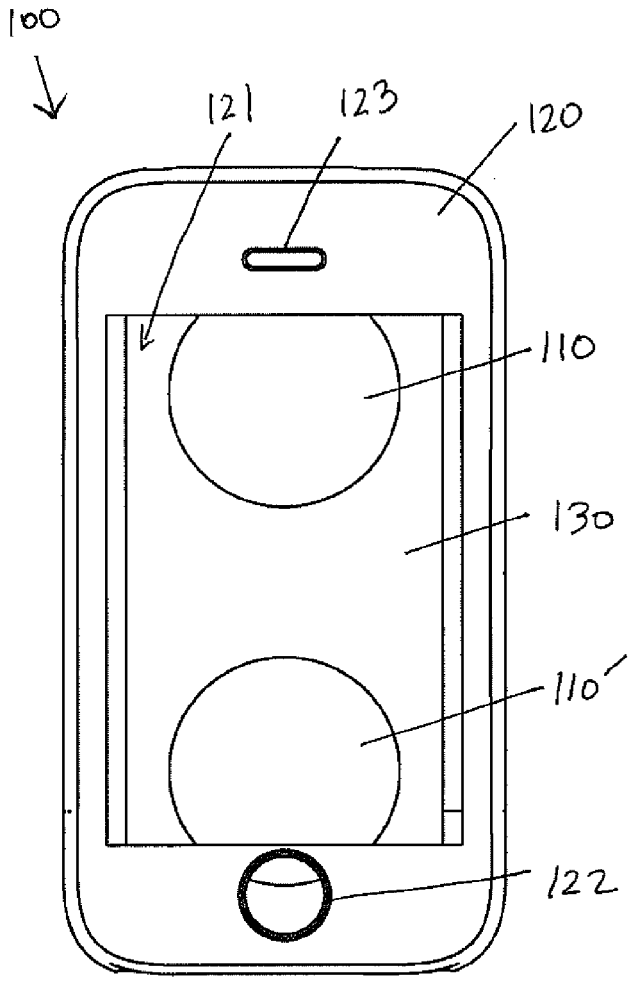
FIG. 2C is a front elevation view of the case of FIGS. 2A-2B.
Figure 2D:
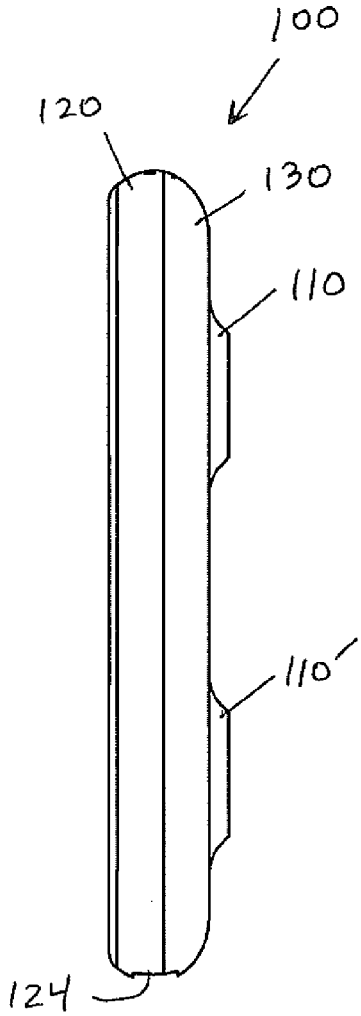
FIG. 2D is a side elevation view of the case of FIGS. 2A-2C.
Figure 2E:
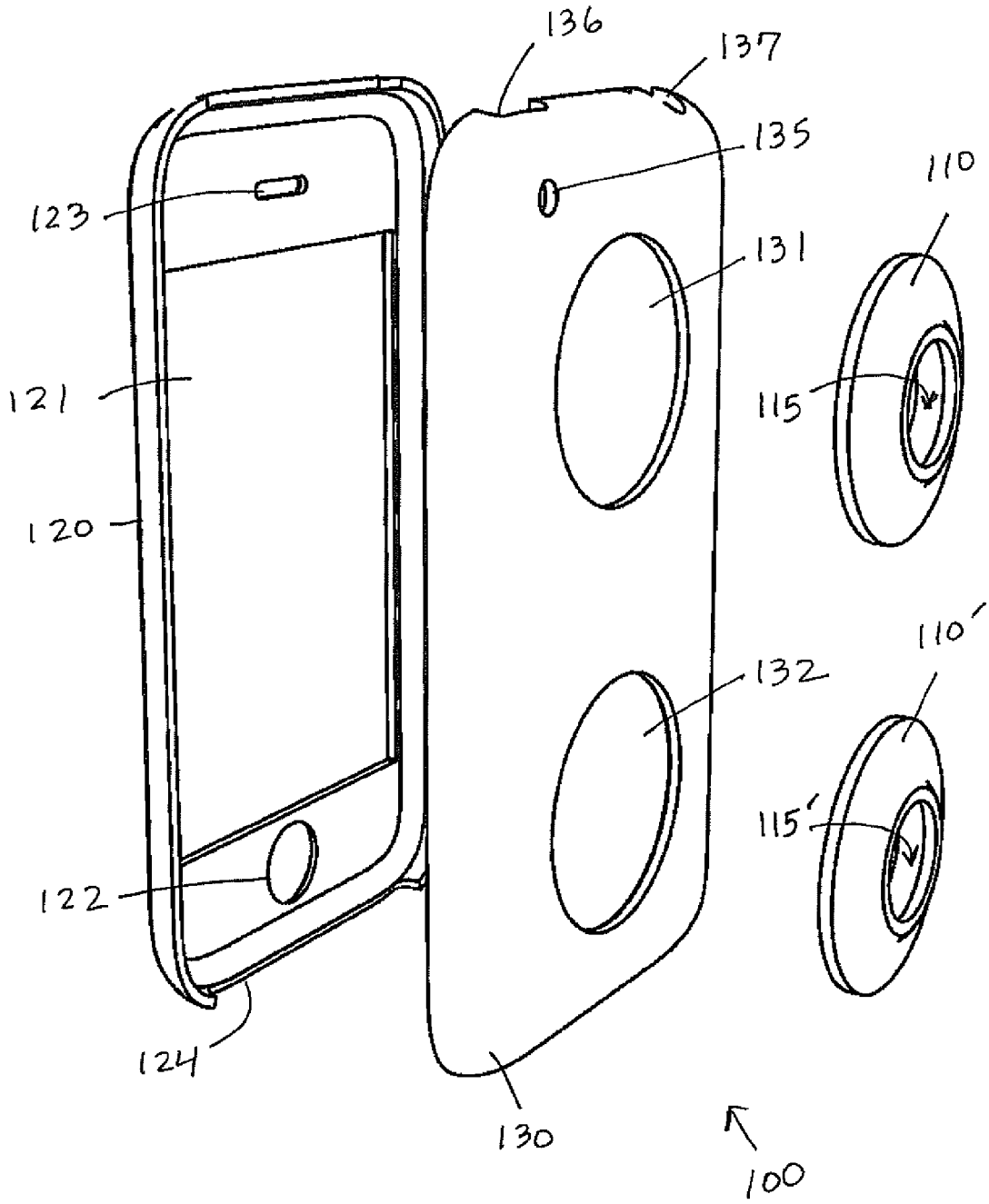
FIG. 2E is an exploded perspective view of the case of FIGS. 2A-2D.
Figure 5A:
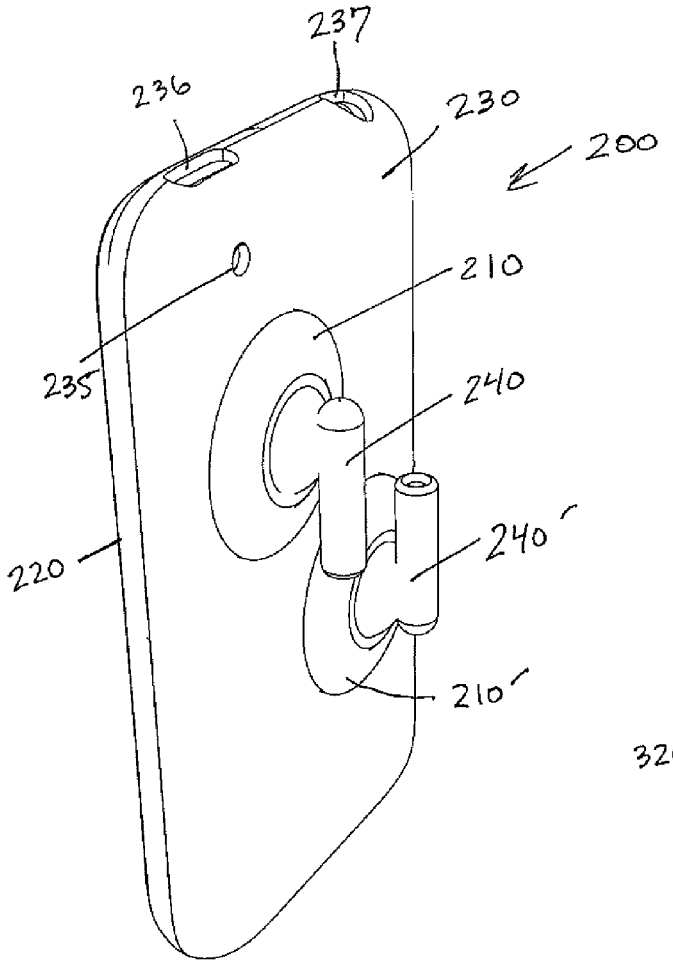
FIG. 5A is a rear perspective view of a second assembled case for a portable digital media device, having first and second earbud headphones disposed partially within an retained by first and second snap fit cavities defined along a rear surface of the case, with the case being similar to the embodiment shown in FIGS. 2A-2E and 4, but with first and second snap fit cavities being laterally offset relative to a vertical median of the case.
Figure 6A:
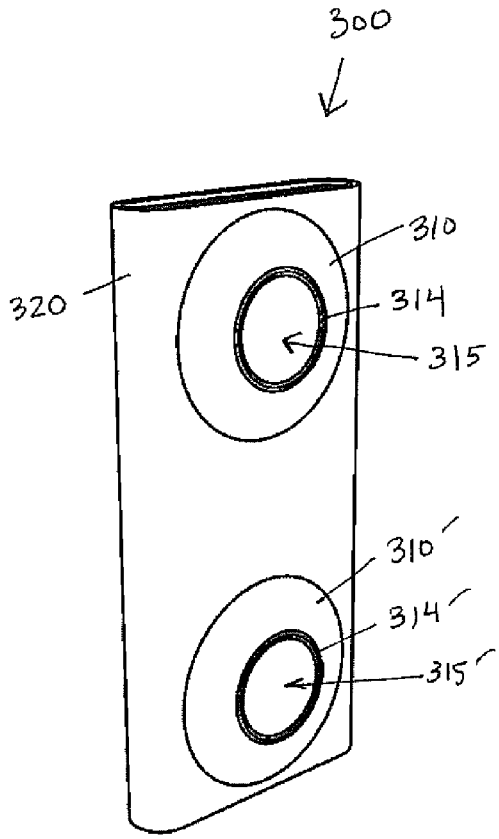
FIG. 6A is a rear perspective view of a third case for a portable digital media device, the case having structure defining first and second snap fit cavities defined a rear surface of the case, and having an open end adapted to permit insertion of a portable digital media device.
Figure 5B:
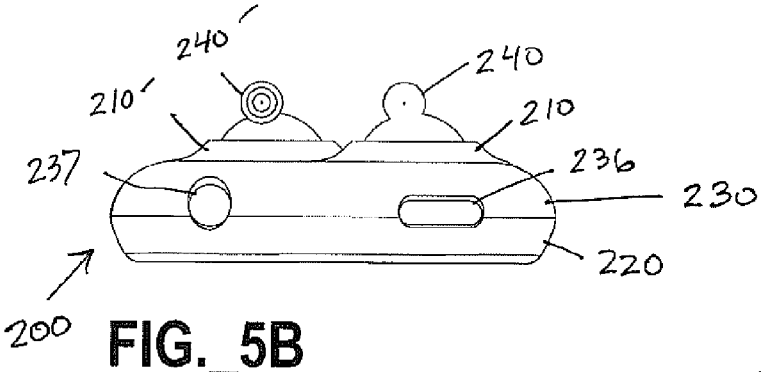
FIG. 5B is a top plan view of the case and earbud headphones of FIG. 5A.
Figure 5C:
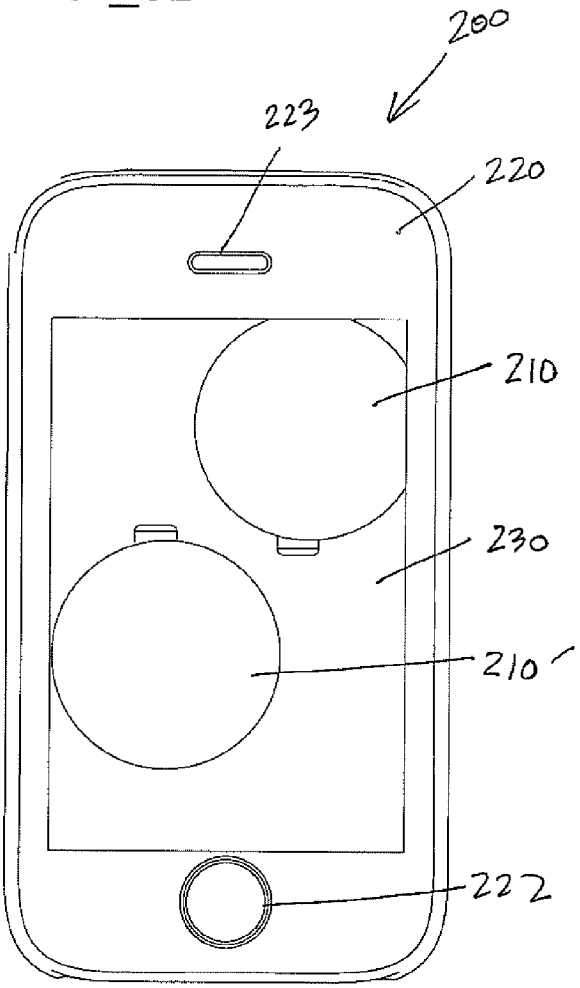
FIG. 5C is a front elevation view of the case and earbud headphones of FIGS. 5A-5B.
Figure 5D:
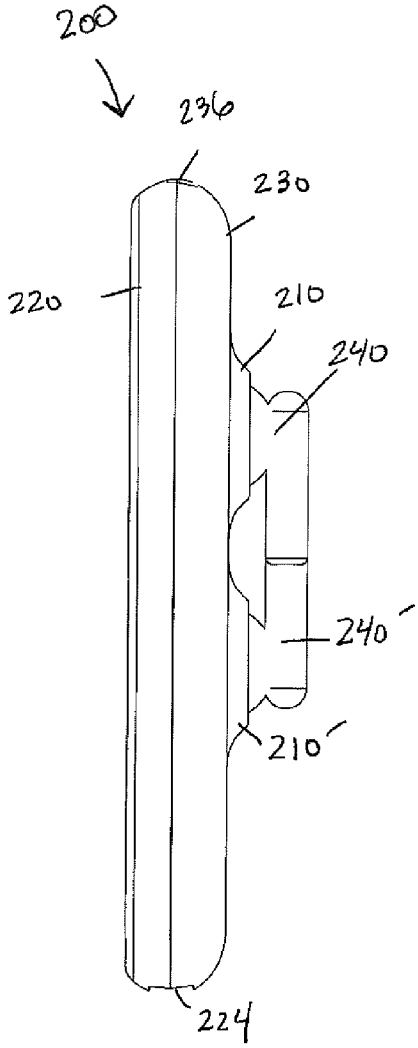
FIG. 5D is a side elevation view of the case and earbud headphones of FIGS. 5A-5C.
Figure 6B:
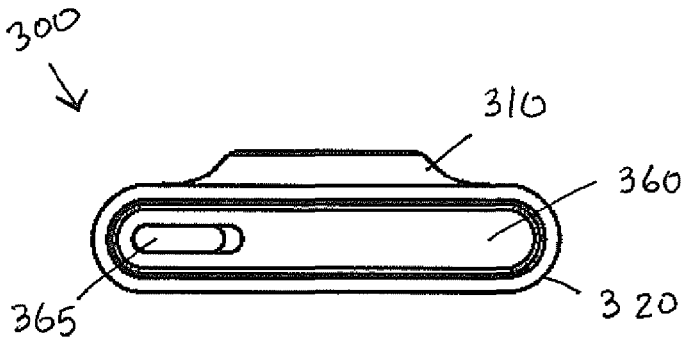
FIG. 6B is a top plan view of the case of FIG. 6A having disposed therein a portable digital media device.
Figure 6C:
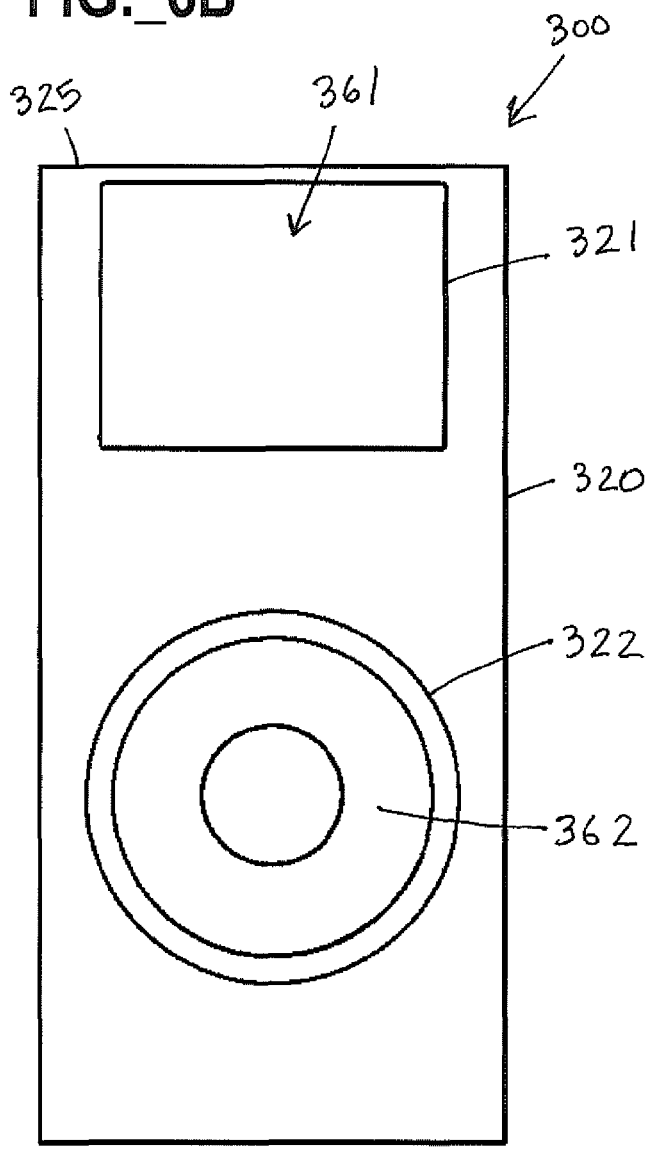
FIG. 6C is a front elevation view of the case and portable digital media device of FIG. 6B
Figure 6D:
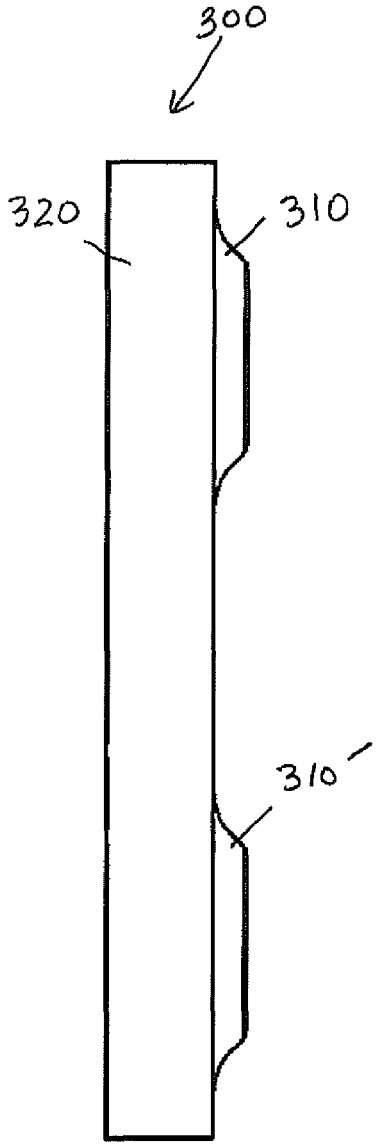
FIG. 6D is a side elevation view of the case of FIGS. 6A-6C.

FIG. 1E illustrates a fifth structure 10E that is similar in all respects to the fourth structure 10D of FIG. 1D except for the formation of an upper surface cavity 13C. The fifth structure 10E comprises a substantially solid material 19E having a lower outer surface 11E, an upper outer surface 12E, and an outer side surface 20E. A mouth 14E defines an upper boundary of a snap fit cavity 15E, which is bounded laterally by a tapered lateral inner surface 16E, a locking radial cavity portion 17E, and lower inner surface 18E. The lateral dimension (e.g., diameter or width) of the cavity 15E generally increases in a direction from the mouth 14E to the lower inner surface 18E, reaching a maximum at the locking radial cavity portion 17E. The reduction in average thickness of the material 19E due to the presence of the upper surface cavity 13E provides enhanced flexibility to the mouth 14E.

FIGS. 2A-2E illustrate a first case 100 formed from two case portions 120, 130 adapted to matably engage one another, and house or otherwise engage a portable digital media device (not shown). Each case portion 120, 130 is preferably formed of a substantially rigid material. The first case portion 120 serves to cover a front portion of a portable digital media device, and a second case portion 130 serves to cover a rear portion of such a device. The first case portion 120 preferably includes a window 121 formed of a substantially clear material (which may be integral with the first case portion 120), along with apertures 122, 123, 124 to permit user access to control elements, feedback elements, or electrical ports associated with a portable digital media device. The second case portion 130 includes apertures 135, 136, 137 to permit user access to control elements, feedback elements, or in electrical ports associated with a portable digital media device, and further includes apertures 131, 132 adapted to receive structures 110, 110' defining first and second snap fit cavities 115, 115', respectively. The first structure 110 defining a first snap fit cavity 115 is bounded by an interior wall 116 and a mouth 114, and similarly, the second structure 110' defining the second snap fit cavity 115' is bounded by an interior wall 116' and a mouth 114'. Each structure 110, 110' is preferably adhered and/or lockably engaged to the second case portion 130 along an aperture 131, 132 thereof, so that each structure 110, 110' is securely and permanently joined to the second case portion 130.

In a preferred embodiment, a snap fit cavity is sized and shaped to retain a headphone earbud to press inserted thereinto. FIGS. 3A-3B show a structure 110 defining a snap fit cavity 115 bounded by an interior wall surface 116 and a mouth 114, with a headphone earbud 140 having the size and shape corresponding to the snap fit cavity 115. FIG. 3A shows a headphone earbud 140 be registered with the snap fit cavity 115. FIG. 3B shows the headphone earbud 140 in the process of being depressibly inserted into the snap fit cavity 115, with the headphone earbud 140 causing slight outward stretching of the mouth 114. FIG. 3C shows the headphone earbud 140 being fully inserted into the snap fit cavity 115. As the mouth 114 has a smaller lateral dimension than the widest portion of the headphone earbud 140 inserted therein, the headphone earbud 140 is securely retained by mouth 114 of the snap fit cavity 115 until a user manipulates the earbud 140 to effectuate its removal from the snap fit cavity 115.

Consistent with FIG. 3C, FIG. 4 shows the case 100 of FIGS. 2A-2E with first and second headphone earbuds 140, 140' retained within snap fit cavities 115, 115' defined in structures 110, 110', respectively. In this manner, the case 100 serves to not only engage and protect a portable digital media device, but also it can organize and protect headphone earbuds 140, 140' when they are not in use.

FIGS. 5A-5D illustrate a second case 200 that is very similar to the case 100 illustrated in FIGS. 2A-2E and FIG. 4, but having snap fit cavity-defining structures 210, 210' that are positioned differently (i.e., laterally offset relative to a vertical centerline) along the second (rear) case portion 230. FIGS. 5A-5D illustrate headphone earbuds 240, 240' as being retained by the snap fit cavity-defining structures 210, 210'. The case 200 is formed from the first and second case portions 220, 230 adapted to matably engage one another and encase a portable digital media device (not shown). The first case portion 220 preferably includes a window 221 formed of a substantially clear material (which may be integral with the first case portion 120), along with apertures 222, 223, 224 to permit user access to control elements, feedback elements, or in electrical ports associated with a portable digital media device. The second case portion 230 includes apertures 235, 236, 237 to permit user access to control elements, feedback elements, or electrical ports associated with a portable digital media device, and further includes apertures 231, 232 adapted to receive structures 210, 210' defining first and second snap fit cavities 215, 215', respectively. The first structure 210 defining a first snap fit cavity 215 is bounded by an interior wall 216 and a mouth 214, and similarly, the second structure 210' defining the second snap fit cavity 215' is bounded by an interior wall 216' and a mouth 214'. Each structure 210, 210' is preferably adhered and/or lockably engaged to the second case portion 230 along an aperture 231, 232 thereof, so that each cavity-defining structure 210, 210' is securely and permanently joined to the second case portion 230. As compared to the previous case embodiment, the embodiment shown in FIGS. 5A-5D demonstrates that placement of first and second snap fit cavity-defining recesses along the case may be varied widely according to the preference of the designer.

FIGS. 6A-6D illustrate a third case 300 that is formed of a single continuous material 320, with the case 300 containing a portable digital media device 360. Such case 300 may be formed, for example, by injection molding, and preferably comprises a substantially optically transmissive material such as clear silicone or the like. The case 300 includes raised structures 310, 310' defining first and second snap fit cavities 315, 315', respectively, with such structures 310, 310' being integrally formed as part of a case 300. Each cavity 315, 315' has an associated mouth 314, 314' that preferably defines the smallest lateral dimension of such cavity 315, 315'. The case 300 preferably has an open and 325 to permit insertion of the portable digital media device 360. The portable digital media device 360 may include control elements 362, 365 and a display 361. The case 300 preferably defines an aperture 322 to permit a user to access the control element 362. A window 321 may be defined in the case 300, whether by use of substantially transparent material, or by local removal of material to prevent occlusion of the display 361. Given that such display 361 may be easily damaged, however, the case 300 preferably includes a protective material over the display 361.

FIGS. 7A-7D illustrate a sew-in or adhered panel 400 (which may additionally or alternatively be adhered in place) having associated structures 410, 410' defining first and second snap fit cavities 415, 415', respectively. The panel 400, which includes a plate 428, is suitable for inclusion in soft and/or wearable cases, such as armbands and the like. Fabric or other soft material is sewn or adhered around the plate 428 to leave exposed the first and second snap fit cavities 415, 415'. Each snap fit cavity 415, 415' is bounded by a mouth 414, 414', respectively. The plate 428 is preferably substantially rigid (e.g., such ABS plastic) to maintain consistent spacing and positioning between the snap fit cavities 415, 415'. The structures 110, 100' may be affixed to the plate 428 by any conventional means.

A primary benefit of the foregoing cases 100, 200, 300 and sew-in or adhered panel panel 400 is that they may be selectively joined with position retention elements of various types, without requiring removal of a portable digital media device disposed therein. A position retention element is desirably used to retain a case, and portable digital media device disposed therein, in a desired position or mounting arrangement. A position retention element for use with the foregoing cases 100, 200, 300 and sew-in or adhered panel 400 has associated therewith a first protrusion element and a second protrusion element adapted for depressible insertion into, and selective retention by, a first snap fit cavity and a second snap fit cavity, respectively. Examples of desirable position retention elements include, but are not limited to, the following: a belt clip, an armband, a clamp, a louver vent clip, a hinged or foldable stand, an adhesive mount, a hook-and-loop fabric mount, and a suction cup mount. Various embodiments of position retention elements incorporating first and second protrusion elements are described hereinafter.

FIGS. 8A-8E illustrate a position retention element in the form of a belt clip 500. The belt clip 500 comprises a first plate 510 having hinge pin retention structures 511 and having associated therewith a first protrusion element 550 and a second protrusion element 550' adapted for depressible insertion into, and selective retention by, corresponding snap fit cavities as described in connection with cases 100, 200, 300 and the sew-in or adhered panel 400 hereinabove. The first and second protrusion elements 550, 550' may be integrally formed with the first plate 510 or affixed to the first plate 510 by any conventional means. The belt clip 500 further comprises a second plate 520 with a pin retention element 522 that permits engagement with the first plate 510 by way of a hinge pin 512, with a spring clip 513 being disposed between the first and second plate 510, 520. The belt clip 500 further comprises a tooth element 524 disposed along a bottom portion of the second plate 520 to contact the first plate 510.

Figure 7B:
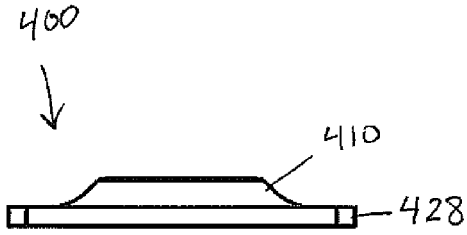
FIG. 7B is a top plan view of the panel of FIG. 7A.
Figure 7C:
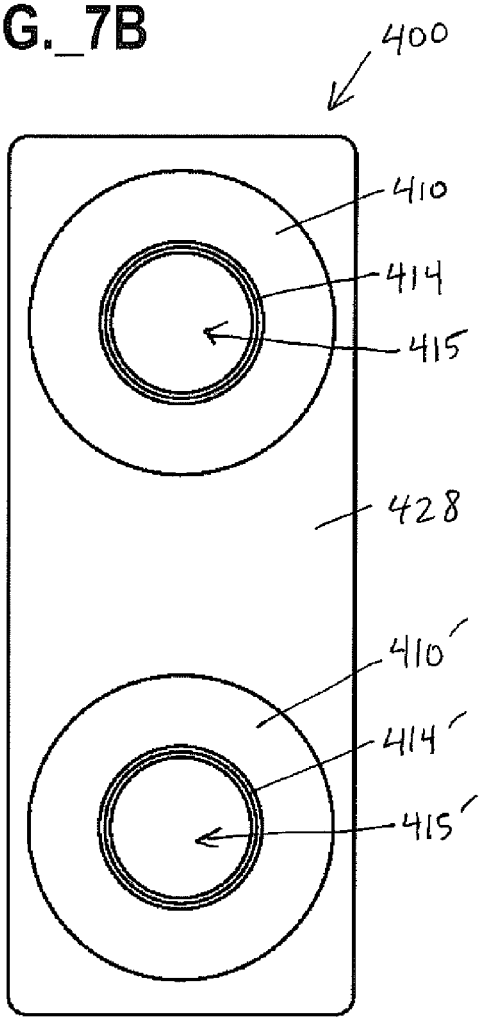
FIG. 7C is a rear elevation view of the panel of FIGS. 7A-7B.
Figure 7D:
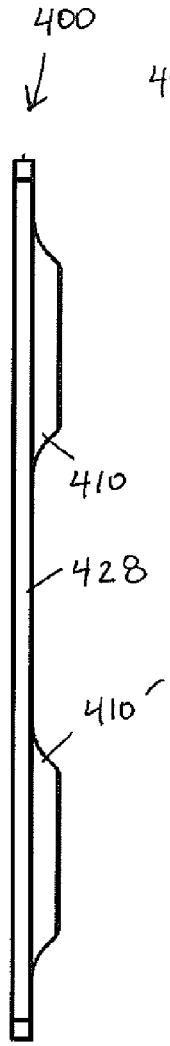
FIG. 7D is a side elevation view of the panel of FIGS. 7A-7C.
Figure 7A:
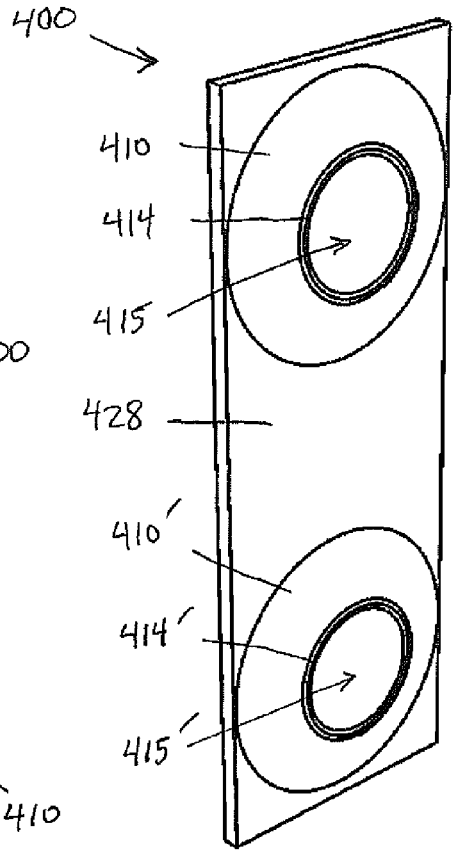
FIG. 7A is a rear perspective view of a panel having structures defining first and second snap fit cavities along a rear surface of the case, the panel being adapted for incorporation into a case for a portable digital media device or otherwise engaged to a portable digital media device.
Figure 8A:
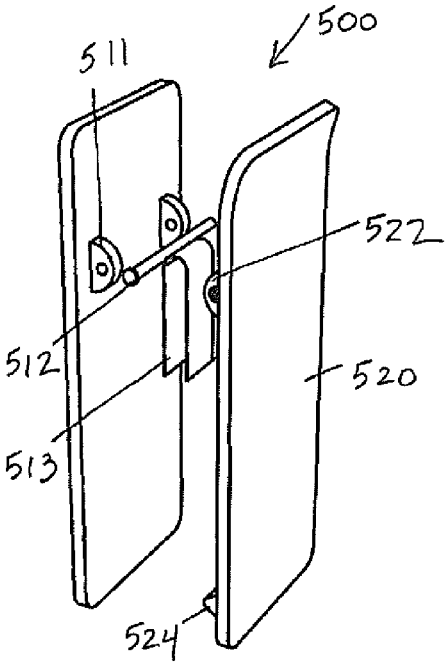
FIG. 8A is an exploded rear perspective view of a first belt clip mounting element adapted for use with any of the cases of FIG. 2A-2E, 5A-5D, or 6A-6D, or panel of FIGS. 7A-7D, the belt clip mounting element having first and second rounded protrusion elements adapted for depressible insertion into first and second snap fit cavities of such a case.
Figure 8C:
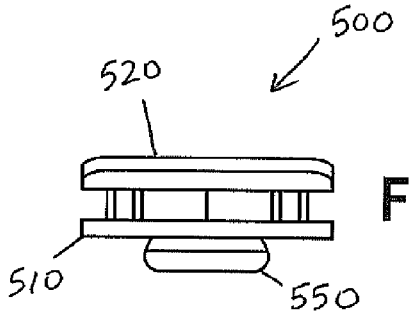
FIG. 8C is a top plan view of the assembled belt clip mounting element of FIG. 8B.
Figure 8B:
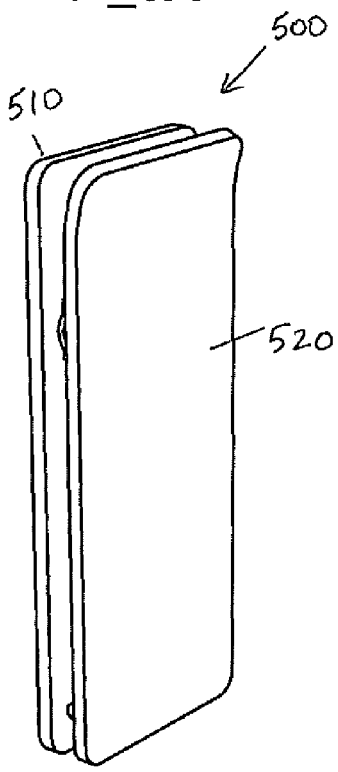
FIG. 8B is a perspective view of the assembled belt clip mounting element of FIG. 8A.
Figure 8D:
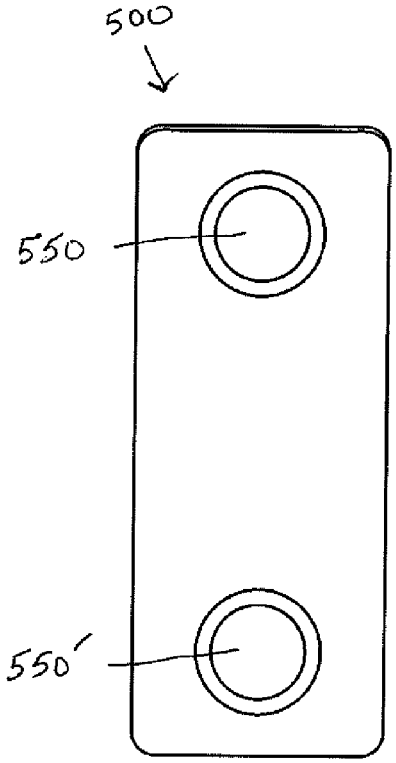
FIG. 8D is a front elevation view of the assembled belt clip mounting element of FIGS. 8B-8C.
Figure 8E:
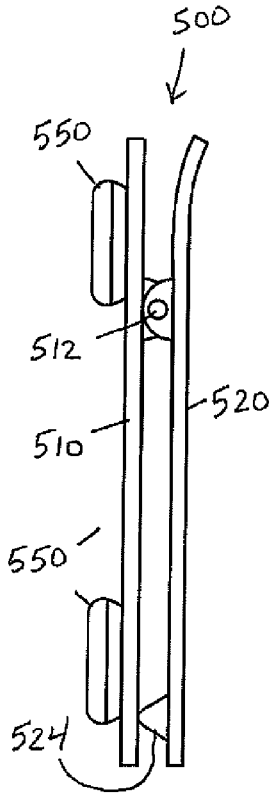
FIG. 8E is a side elevation view of the assembled belt clip mounting element of FIGS. 8B-8D.

FIGS. 9A-9B illustrate a belt clip 500A (similar to the belt clip 500 of FIGS. 8A-8E) registered to a sew-in or adhered panel 400A (similar to the panel 400 of FIGS. 7A-7C). The belt clip 500A includes a first plate 510A and a second plate 520A joined with a hinge pin 512A, with the second plate 520A including a tooth element 524A, and with the first plate 510A having joined to or otherwise associated therewith a first protrusion element 550A and a second protrusion element 550A'. Each protrusion element 550A, 550A' has an associated outwardly projecting portion 557A, 557A', respectively, adapted to mate with a locking radial cavity portion of a snap fit cavity. The sew-in or adhered panel 400A includes a plate element 428A having associated structures 410A, 410A' defining first and second snap fit cavities 415A, 415A', respectively. Each snap fit cavity 415A, 415A' is bounded by a lip 414A, 414A', an interior wall portion 416A, 416A', and a locking radial cavity portion 417A, 417A'. As shown in FIG. 9A, the first structure 410A defining the first snap fit cavity 415A includes a lower inner surface 418A, and a medial upper outer surface portion 412A that this to a lateral upper outer surface portion 413A. To engage the belt clip 500A to the sew-in or adhered panel 400A, the items are registered to one another (as shown in FIGS. 9A-9B, and either the belt clip 500A or the belt clip 400A is pressed against the other to effectuate depressible insertion of the protrusion elements 550A, 550A' into the corresponding snap fit cavities 415A, 415A'. Upon full insertion, the outwardly protecting portion 557A, 557A' of each protrusion 550A, 550A' mates with the corresponding locking radial cavity portion 417A, 417A' of the respective snap fit cavity 415A, 415A'. Removal is accomplished applying tension to the protrusion elements 550A, 550A' (e.g., by pulling either the belt clip 550A or the sew-in panel 400A apart fro the other), optionally accompanied by application of pivoting or twisting motion.

Figure 10A:
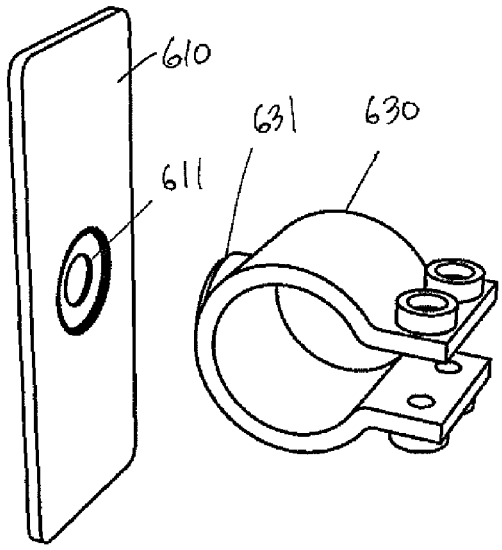
FIG. 10A is an exploded perspective view of a handlebar or rod mounting element adapted for use with any of the cases of FIG. 2A-2E, 5A-5D, or 6A-6D, or panel of FIGS. 7A-7D, the handlebar or rod mounting element having first and second rounded protrusion elements adapted for depressible insertion into first and second snap fit cavities of such a case.
Figure 10B:
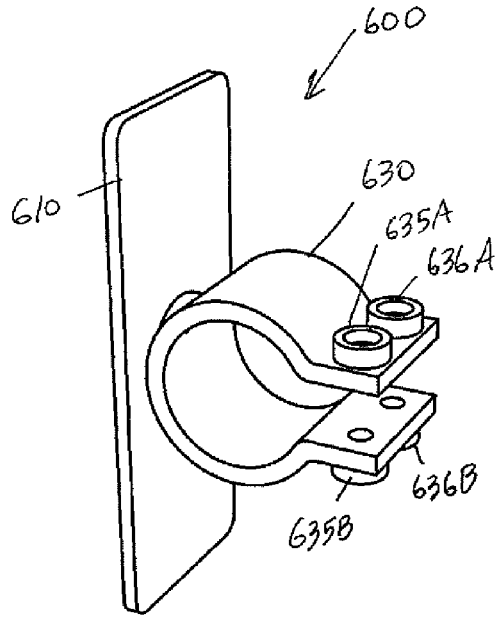
FIG. 10B is a rear perspective view of the assembled handlebar or rod mounting element of FIG. 10A.
Figure 10C:
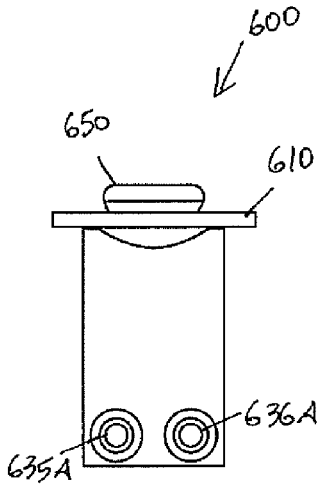
FIG. 10C is a top plan view of the handlebar or rod mounting element of FIG. 10B.
Figure 10D:
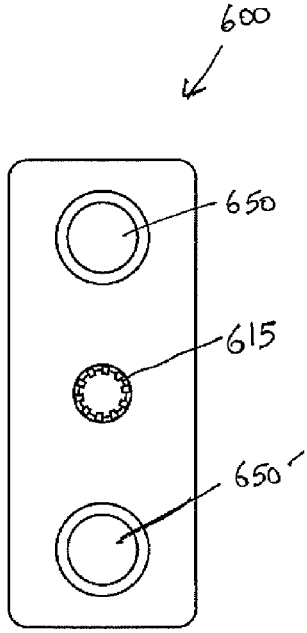
FIG. 10D is a front elevation view of the handlebar or rod mounting element of FIGS. 10B-10C.
Figure 10E:
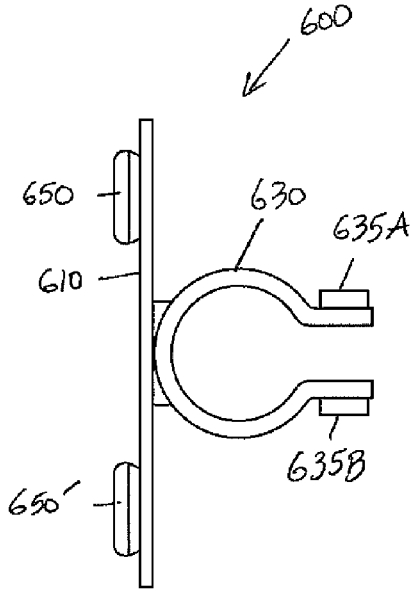
FIG. 10E is a side elevation view of the handlebar or rod mounting element of FIGS. 10B-10D.
Figure 11A:
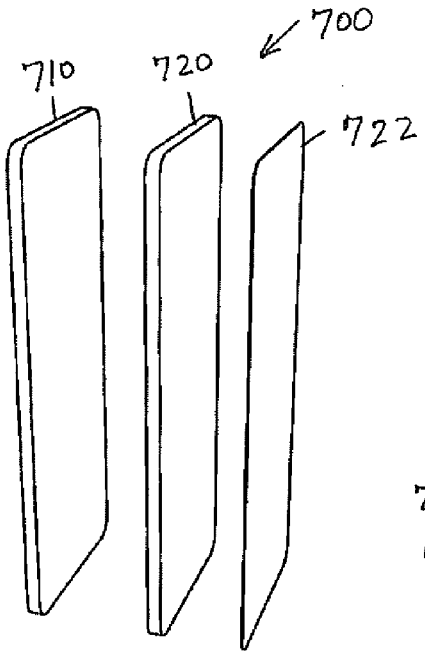
FIG. 11A is an exploded rear perspective view of an adhesive surface mounting element adapted for use with any of the cases of FIG. 2A-2E, 5A-5D, or 6A-6D, or panel of FIGS. 7A-7D, the adhesive surface mounting element having first and second rounded protrusion elements adapted for depressible insertion into first and second snap fit cavities of such a case.
Figure 11C:
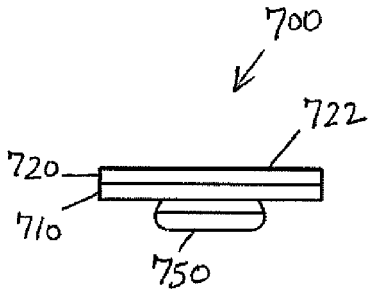
FIG. 11C is a top plan view of the adhesive surface mounting element of FIG. 11B.
Figure 11B:
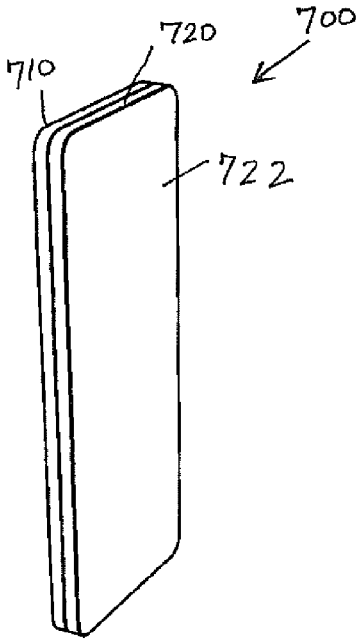
FIG. 11B is a rear perspective view of the assembled adhesive surface mounting element of FIG. 11A.
Figure 11D:
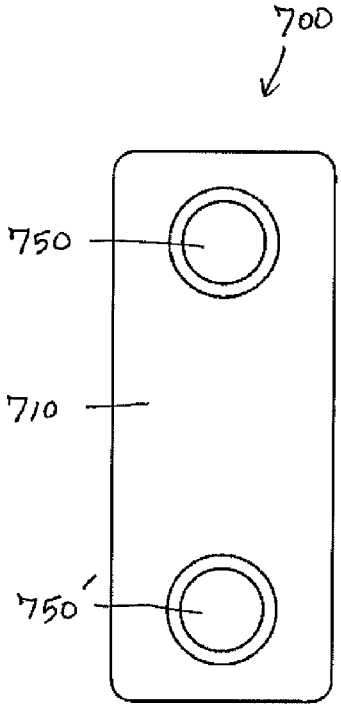
FIG. 11D is a front elevation view of the adhesive surface mounting element of FIGS. 11B-11C.
Figure 11E:
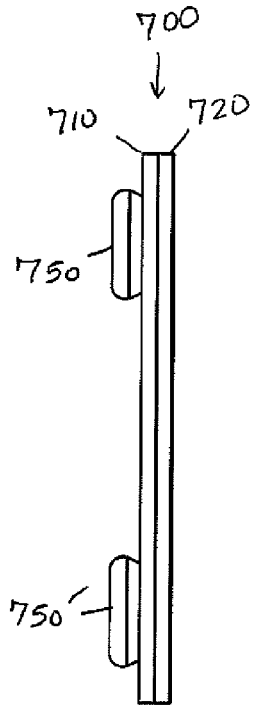
FIG. 11E is a side elevation view of the adhesive surface mounting element of FIGS. 10B-10D.
Figure 12A:
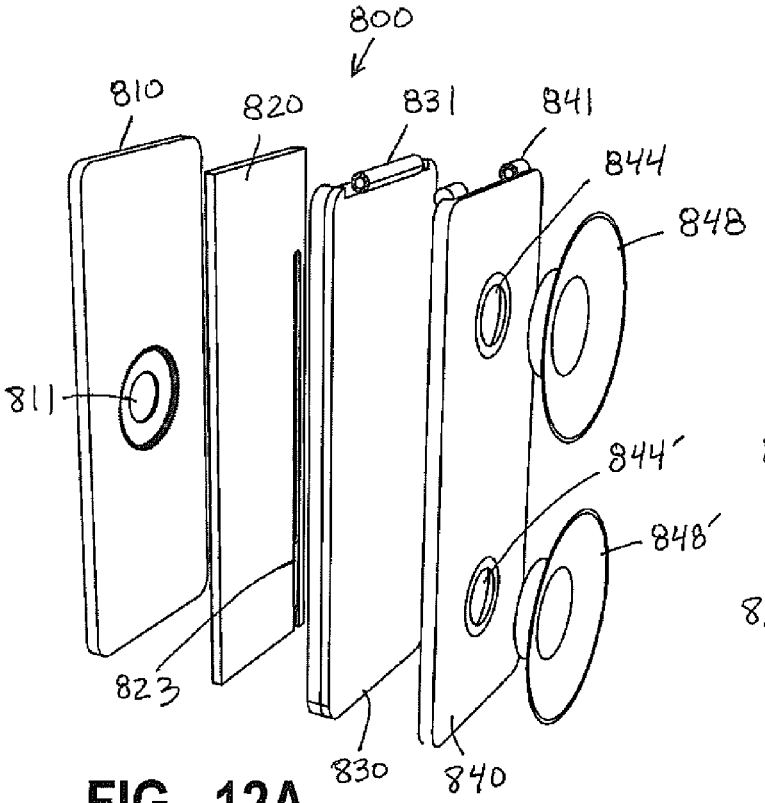
FIG. 12A is an exploded rear perspective view of a suction cup-containing folding stand mounting element adapted for use with any of the cases of FIG. 2A-2E, 5A-5D, or 6A-6D, or panel of FIGS. 7A-7D, the folding stand mounting element having first and second rounded protrusion elements adapted for depressible insertion into first and second snap fit cavities of such a case.
Figure 12B:
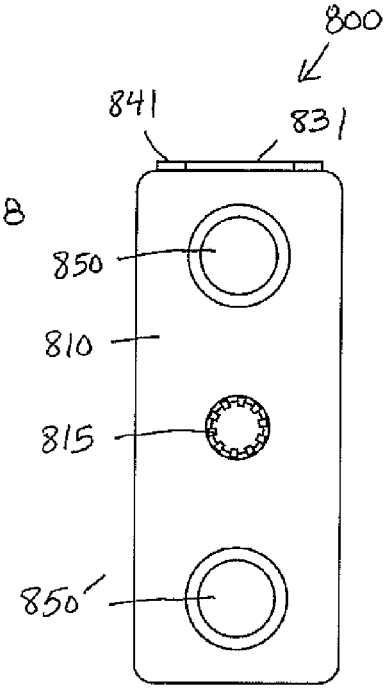
FIG. 12B is a front elevation view of the assembled folding stand mounting element of FIG. 12A.
Figure 12C:
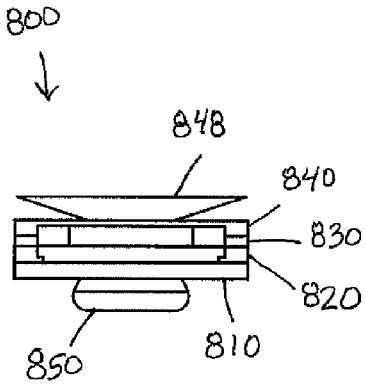
FIG. 12C is a top plan view of the folding stand mounting element of FIG. 12B.
Figure 12D:
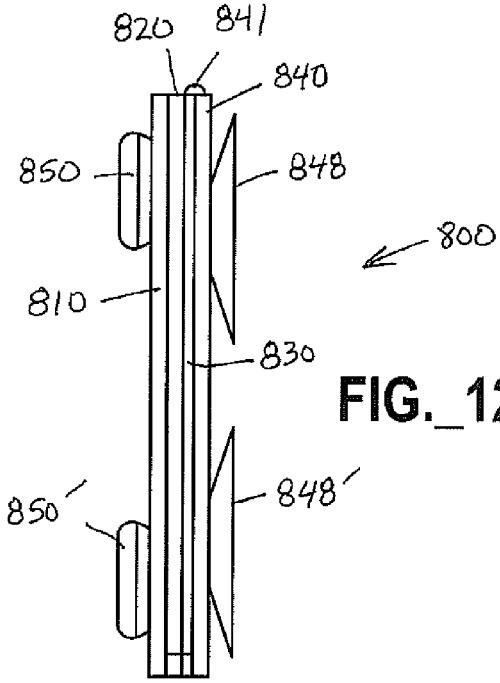
FIG. 12D is a side elevation view of the folding stand mounting element of FIGS. 12B-12C.
Figure 13A:
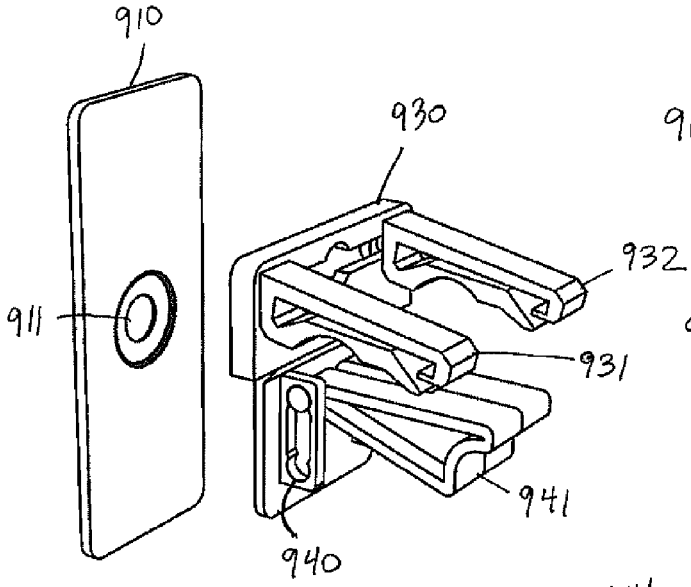
FIG. 13A is an exploded rear perspective view of a louver vent clip mounting element adapted for use with any of the cases of FIG. 2A-2E, 5A-5D, or 6A-6D, or panel of FIGS. 7A-7D, the louver vent clip mounting element having first and second rounded protrusion elements adapted for depressible insertion into first and second snap fit cavities of such a case.
Figure 13B:
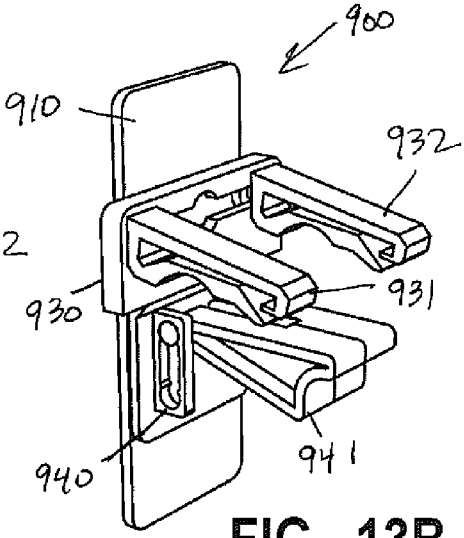
FIG. 13B is a rear perspective view of the assembled louver vent clip mounting element of FIG. 13A.
Figure 13C:
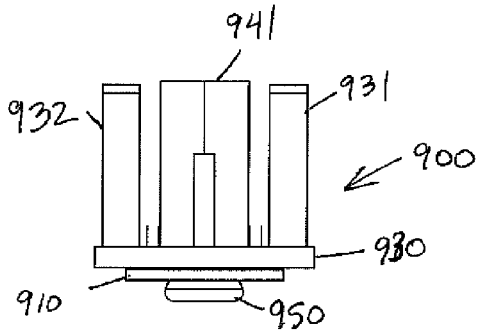
FIG. 13C is a top plan view of the louver vent clip mounting element of FIG. 13B.
Figure 13D:
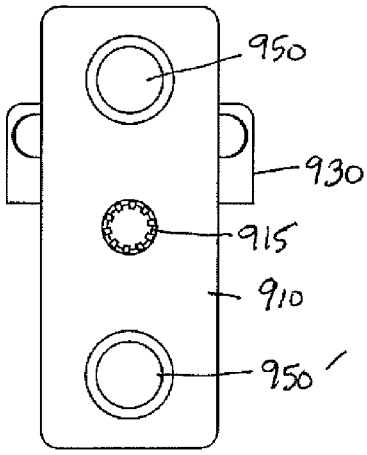
FIG. 13D is a front elevation view of the louver vent clip mounting element of FIGS. 13B-13C.
Figure 13E:
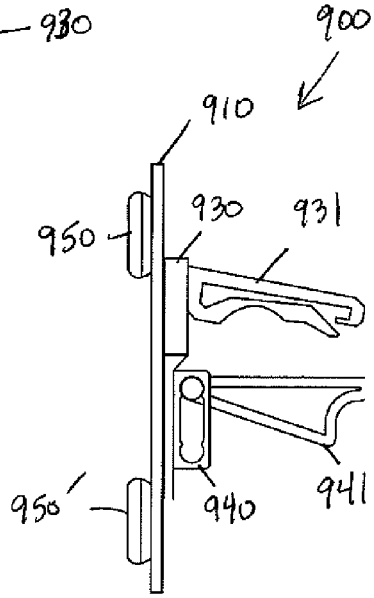
FIG. 13E is a side elevation view of the louver vent clip mounting element of FIGS. 13B-13D.
Figure 14B:
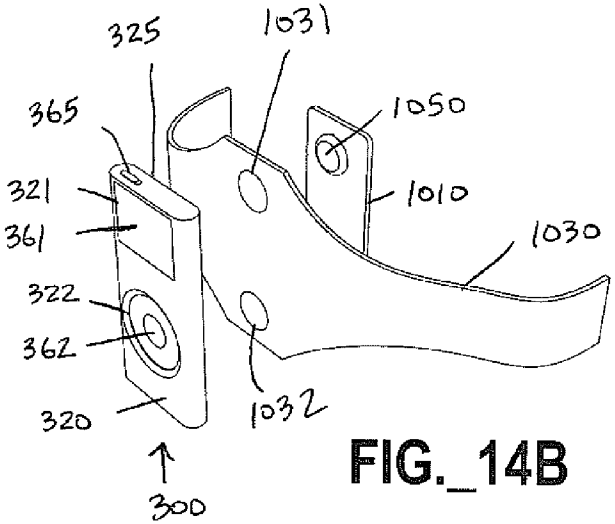
FIG. 14B is an exploded perspective view of the armband and portable digital media device-containing case of FIG. 14A.
Figure 14C:
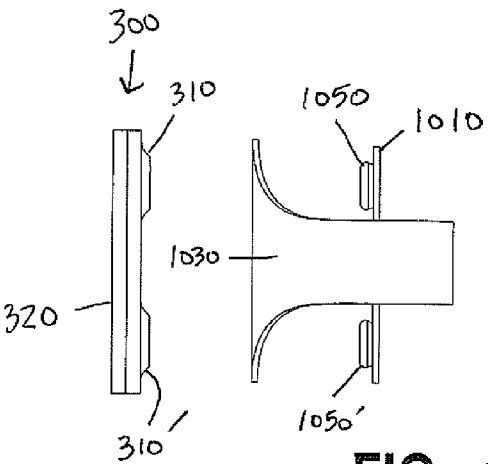
FIG. 14C is an exploded side elevation view of the armband and portable digital media device-containing case of FIGS. 14A-14B.
Figure 14A:
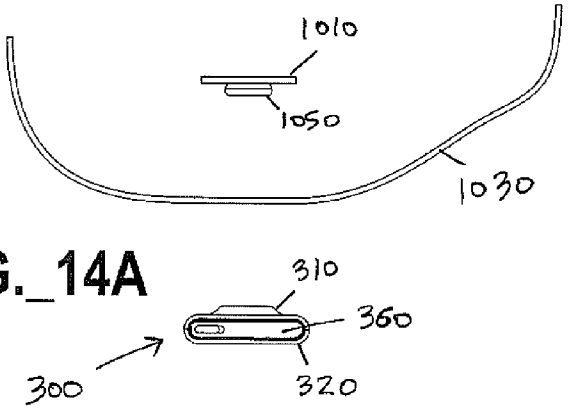
FIG. 14A is an exploded plan view of an armband having plate-mounted first and second protrusions insertable through a wearable strap, and the case of FIGS. 6A-6D containing a portable digital media device.
Figure 14E:
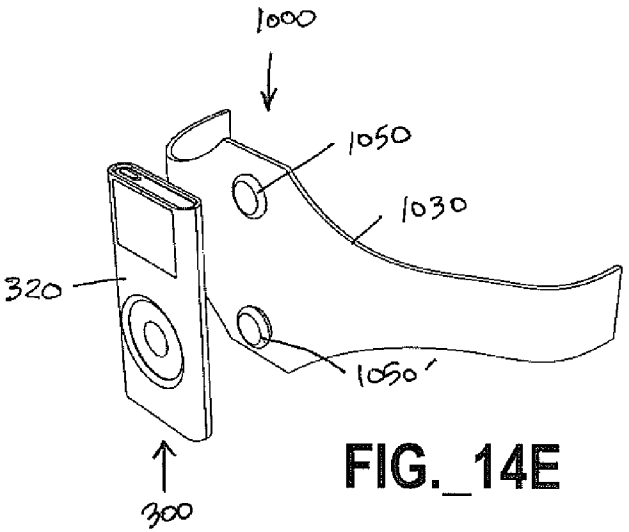
FIG. 14E is an exploded perspective view of the armband and case of FIG. 14D.
Figure 14F:
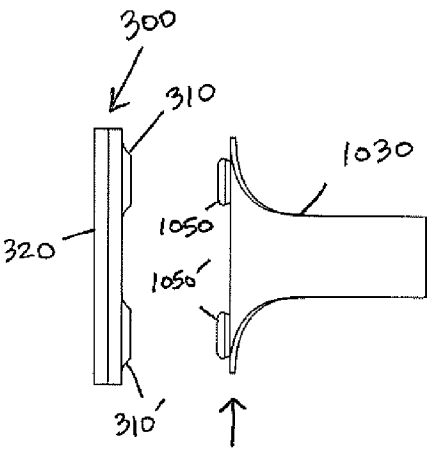
FIG. 14F is a side elevation view of the armband and case of FIGS. 14D-14E.
Figure 14D:
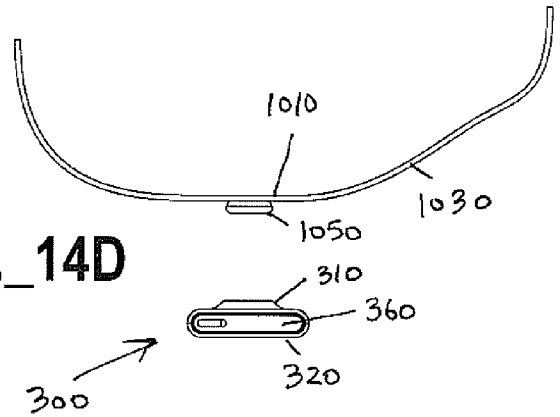
FIG. 14D is a plan view of the assembled armband of FIGS. 14A-14C registered to the case shown in FIGS. 14A-14C for depressible insertion of the first and second protrusions of the armband into first and second snap fit cavities of the case.
Figure 14G:
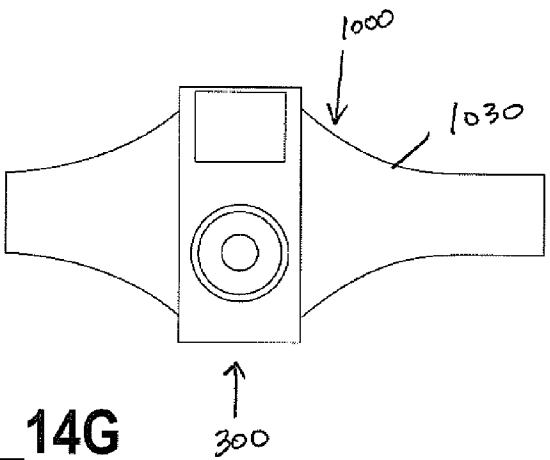
FIG. 14G is a front elevation view of the case of FIGS. 14D-14F mounted to the armband of FIGS. 14D-14F.

FIGS. 10A-109E illustrate a position retention element in the form of a clamp 600. The clamp 600 includes a plate 610 and a clamp portion 630 that are joined to one another with a flared nut, rivet, screw, or other fastener 615 inserted through an aperture 611 defined in the plate 610 to engage an aperture 631 defined in the clamp portion 630. The clamp portion 630 further includes bolt receptacles 635A, 635B, 636A, 636B adapted to receive first and second bolts (not shown) to actuate the clamp portion 630 to engage a bicycle handlebar, a rod, or similar tubular structure. A first protrusion element 650 and a second protrusion element 650 adapted for depressible insertion into corresponding snap fit cavities (not shown) are joined to or otherwise associated with the plate 610. To engage the clamp 600 to any of the cases 100, 200, 300 or the sew-in or adhered panel 400, corresponding protrusion elements and snap fit cavities are registered to one another, and each protrusion element is depressibly inserted into a snap fit cavity.

FIGS. 11A-11E illustrate a position retention element in the form of an adhesive mount 700. The adhesive mount includes a plate 710, a double-sided adhesive layer 720, and a cover layer 722 that is peelably removable from the adhesive layer 720. First and second protrusion elements 750, 750' are affixed or otherwise joined to the plate 710. Upon removal of the cover layer 722, the exposed surface of the adhesive layer 720 may be affixed to any suitable surface, thereby exposing the protrusion elements 750, 750' to permit engagement thereto (e.g., via depressible insertion) of a case having corresponding snap fit cavities.

FIGS. 12A-12D illustrate a position retention element in the form of a pivotal stand 800 having suction cup elements 848, 848'. The stand 800 includes a first plate 810 (to which protrusion elements 850, 850' are joined or affixed) defining a medial aperture 811, a second plate 820 defining a slot 823, a third plate 830 defining a first hinge portion 831, and a fourth plate 841 defining second hinge portions 841 and apertures 844, 844' adapted to receive suction cup elements 848, 848', respectively. The second plate 820 may be affixed to the first plate 810 by way of a fastener 815 disposed through the medial aperture 811. Alternatively, the second plate 820 may comprise an adhesive surface to effectuate joining to the first 810. The slot 823 includes ridges (not shown) that allow the third plate 830 to index up and down the length of the plate 820 to maintain a portable digital media device (not shown) in an elevated position. In operation, the pivotal stand 800 may be optionally mounted via suction to an appropriate surface by way of the suction cup elements 848, 848'. The first through third plates 810, 820, 830 may be pivoted relative to the fourth plate 840 via the hinge elements 831, 841. In a pivotally open position, the stand 800 may rest in an upright position on a table or other flat surface (not shown) to thereby support a case containing a portable digital media device. The first protrusion element 850 and second protrusion element 850' are adapted for depressible insertion into corresponding snap fit cavities (not shown) of such a case.

FIGS. 13A-13E illustrate a position retention element in the form of a louver vent clip 900 comprising a first plate 910 and a second plate 930 having associated spring clips 931, 932 and a hinged support 941, with the spring clips 931, 932, and hinged support 941 being adapted for mating with louver elements (not shown) of a louvered vent of a motor vehicle ventilation system. The first plate 910 defines a medial aperture 911 to permit a fastener 915 to join the second plate 930 thereto. The second plate 930 includes pivot supports 940 adapted to allow pivotal movement of the pivot element 941. A first protrusion element 950 and a second protrusion element 950' are joined or affixed to the first plate 910 to permit engagement thereto of any of the foregoing cases 100, 200, 300 or sew-in/adhered panel 400.

FIGS. 14A-14G illustrate various elements of an armband 1000 having a plate 1010 adapted to receive and retain a case 300 holding a portable digital media device 360. The armband 1000 includes a strap 1030 defining first and second apertures 1031, 1032 through which protrusion elements 1050, 1050' associated with the plate 1010 are inserted. The plate 1010 may or may not be sewn into the strap 1030. The case 300 has an open end 325 adapted to permit insertion and removal of the portable digital media device 360, with a window portion 321 of the case 300 permitting viewing of a display 361 of the device 360, with an aperture 322 defined by the wall 320 of the case 300 permitting user access to a control element 362 provided along a front surface of the device 360. The open end 325 of the case 300 further permits user access to a control element 365 disposed along an upper surface of the portable digital media device 360. The case 300 further includes structures 310, 310 defining snap fit cavities (not shown). In use, the protrusions 1050, 1050' associated with the armband 1000 are depressibly inserted into the respective snap fit cavities of the case 300, such that the protrusions 1050, 1050' are selectively retained by the cavities until removal by the user.

In one embodiment, any of the foregoing cases or sew-in/adhered panels may be combined with any of the foregoing position retention elements to form a kit. Multiple cases, panels, and/or position retention elements may aggregated in such a kit.

Various specific types of portable digital media devices are contemplated with cases, mounting devices, and/or position retention elements according to the present invention. For example, the broad class of portable digital media devices may include any of (i) a digital audio storage and playback device; (ii) a digital video storage and playback device; (iii) a digital image storage and playback device; (iv) a portable telephone; (v) a personal digital assistant device, and devices combining the functions of two or more of the foregoing items.

As will be apparent from the preceding disclosure, the invention includes a method for positioning or mounting a portable digital media device, including: (i) engaging said portable digital media device to an engagement element having associated therewith a first snap fit cavity and a second snap fit cavity, said first snap fit cavity being dimensioned to receive and selectively retain a first protrusion element, and said second snap fit cavity being dimensioned to receive and selectively retain a second protrusion element; (ii) manipulating a position retention element into a desired position or mounting arrangement, said position retention element having associated therewith said first protrusion element and said second protrusion element; (iii) registering (a) the first protrusion element with the first snap fit cavity, and (b) the second protrusion element with the second snap-fit cavity; and (iv) depressing any of the engagement element and the position retention element against the other to effectuate insertion of the first protrusion element into the first snap fit cavity, and insertion of the second protrusion element into the second snap fit cavity.

The invention thus encompasses highly versatile mounting devices and cases for portable digital media devices, and methods for their use, that permit a user to maintain a portable digital media device retained within a case, and selectively engage or remove said case relative various accessory mounts or positioning elements with minimal user manipulation.

While the invention has been has been described herein in reference to specific aspects, features and illustrative embodiments of the invention, it will be appreciated that the utility of the invention is not thus limited, but rather extends to and encompasses numerous other variations, modifications and alternative embodiments, as will suggest themselves to those of ordinary skill in the field of the present invention, based on the disclosure herein. Correspondingly, the invention as hereinafter claimed is intended to be broadly construed and interpreted, as including all such variations, modifications and alternative embodiments, within its spirit and scope.

What is claimed is:

1. A case for mounting a portable device in a desired position, the case comprising:

an engagement element including at least one snap fit cavity having a substantially circular opening and an interior surface to removably attach to said portable device; and a position retention element including a mechanism adapted to maintain said engagement element and the portable device in the desired position, wherein said mechanism comprises at least one of a belt clip, an armband, a clamp, a louver vent clip, a hinged or foldable stand, an adhesive mount, a hook-and-loop fabric mount, and a suction cup mount, and at least one protrusion element depressibly insertable into a corresponding substantially circular opening of the at least one snap fit cavity, wherein each opening of the at least one snap fit cavity is adapted to receive and selectively retain a corresponding protrusion element, and is accessible after the portable device is attached by the engagement element.

2. The case of claim 1, wherein each of the at least one snap fit cavity is formed in a manner selected from at least one of integrally formed in or on said engagement element; is defined by at least one surface comprising a slip-resistant material; is defined by at least one surface comprising a pliable, flexible, or elastic material; and is defined by a threadless surface.

3. The case of claim 1, wherein the portable device is selected from the group consisting of a digital audio storage and playback device; a digital video storage and playback device; a digital image storage and playback device; a portable telephone; and a personal digital assistant device.

4. The mounting device of claim 1, wherein each protrusion element comprises a slip-resistant material.

5. The case of claim 1, wherein each opening is sized and shaped to receive and retain a headphone earbud when the protrusion element is not inserted into the corresponding snap fit cavity.

6. The case of claim 1, further comprising a plurality of portions formed of any of non-rigid, pliable, and substantially non-pliable material to house said portable device therein, said plurality of portions comprising a first case portion and a second case portion adapted to mate to each other, wherein said engagement element comprises a sew-in panel or adhered panel having formed therein or thereon at least one snap fit cavity, and said case comprises a soft covering material sewn or adhered over at least a portion of said sew-in panel or adhered panel, wherein said soft covering material comprises any of fabric, animal skin, polymeric material, and synthetic rubber material.

7. The case of claim 1, wherein the case is adapted to cover at least portions of multiple sides of the portable device.

8. A case adapted to maintain a desired position or mounting arrangement of a portable device, the case comprising:

an engagement element including a plurality of snap fit cavities each having a substantially circular opening and an interior surface to removably attach to said portable device a mechanism for retaining position of said portable device, wherein said mechanism comprises at least one of a belt clip, an armband, a clamp, a louver vent clip, a hinged or foldable stand, an adhesive mount, a hook-and-loop fabric mount, and a suction cup mount; and a plurality of protrusion elements attached to said mechanism, each protrusion element corresponding to a respective opening of the plurality of snap fit cavities and being shaped and dimensioned for depressible insertion into and selective retention by the respective opening.

9. The case of claim 8, wherein said case is formed as a protective case.

10. The case of claim 8, wherein each of said plurality of snap fit cavities is formed in a manner selected from at least one of integrally formed in or on said engagement element;

defined by at least one surface comprising a slip-resistant material, and a slip-resistant material;

defined by at least one surface comprising a pliable, flexible, or elastic material, and wherein each said protrusion element comprises a pliable, flexible, or elastic material; and is defined by a threadless surface.

11. The case of claim 8, wherein the case is adapted to cover at least portions of multiple sides of the portable device.

12. The case of claim 8, wherein each opening is sized and shaped to receive and retain a headphone earbud when the corresponding protrusion element is not inserted into the snap fit cavity.

13. A case for a portable device, the case comprising:

an engagement element having an interior surface to removably attach to a portable device to cover at least portions of multiple sides of the portable device, said engagement element including a window to permit viewing of a display associated with said portable device;

a plurality of protrusion elements; and a mechanism connected to said protrusion elements and including at least one of a belt clip, an armband, a clamp, a louver vent clip, a hinged or foldable stand, an adhesive mount, a hook-and-loop fabric mount, and a suction cup mount connected to said protrusion elements, and a plurality of snap fit cavities disposed in or on said engagement element, each snap fit cavity having a substantially circular opening dimensioned to receive and selectively retain a corresponding protrusion elementof the plurality of protrusion elements that is depressibly insertable into said opening, each snap fit cavity is accessible after the portable device is attached by the engagement element.

14. The case of claim 13, wherein each snap fit cavity is adapted to receive and retain a headphone earbud operable with said portable device, and is defined by a threadless surface, and said engagement element comprises any of a non-rigid covering material and a pliable covering material adapted to cover at least a portion of said portable device.

15. The case of claim 14, wherein said position retention element is adapted to maintain said engagement element and the retained portable device in a desired position or mounting arrangement.

16. The case of claim 13, wherein the engagement element comprises at least one of a non-rigid covering material and a pliable covering material; multi-part case adapted to house said portable device therein, a substantially non-pliable material; and a sew-in panel or adhered panel having formed therein or thereon said first snap fit cavity and said second snap fit cavity, and wherein said case comprises a soft covering material sewn or adhered over at least a portion of said sew-in panel or adhered panel, wherein said soft covering material comprises any of fabric, animal skin, polymeric material, and synthetic rubber material.

17. A method for positioning or mounting a portable digital media device, the method comprising:

engaging said portable digital media device to a case according to claim 13;

manipulating a position retention element into a desired position or mounting arrangement, said position retention element having associated therewith a first protrusion element being depressibly insertable into said first snap fit cavity and a second protrusion element being depressibly insertable into said second snap fit cavity;

registering (a) the first protrusion element with the first snap fit cavity, and (b) the second protrusion element with the second snap fit cavity; and depressing any of the engagement element and the position retention element against the other to effectuate insertion of the first protrusion element into the first snap fit cavity, and insertion of the second protrusion element into the second snap fit cavity.

* * * * *